US010191409B2

(12) United States Patent
Saito

(10) Patent No.: US 10,191,409 B2
(45) Date of Patent: Jan. 29, 2019

(54) IMAGE FORMING APPARATUS HAVING CONTROLLED TONER DISCHARGE AMOUNT

(71) Applicant: CANON KABUSHIKI KAISHA, Tokyo (JP)

(72) Inventor: Fumiyoshi Saito, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/602,269

(22) Filed: May 23, 2017

(65) Prior Publication Data

US 2017/0343925 A1 Nov. 30, 2017

(30) Foreign Application Priority Data

May 27, 2016 (JP) ..... 2016-105794

(51) Int. Cl.
*G03G 15/08* (2006.01)

(52) U.S. Cl.
CPC . *G03G 15/0863* (2013.01); *G03G 2215/0697* (2013.01)

(58) Field of Classification Search
CPC ..... G03G 15/0834; G03G 15/0836; G03G 15/0839; G03G 15/0863; G03G 15/0868; G03G 15/087; G03G 15/0877; G03G 2215/066; G03G 2215/0663; G03G 2215/0685; G03G 2215/0695; G03G 2215/0697
USPC ..... 399/12, 29, 258, 262
See application file for complete search history.

(56) References Cited

U.S. PATENT DOCUMENTS 7,003,233 B2 * 2/2006 Matsuda ..... G03G 15/0849 399/27
8,000,615 B2 8/2011 Mizuyama
9,354,577 B2 5/2016 Nose et al.
9,645,527 B2 5/2017 Saito et al.
(Continued)

FOREIGN PATENT DOCUMENTS

JP 2004109998 A * 4/2004 ..... G03G 15/0849
JP 2009-223144 A 10/2009
(Continued)

*Primary Examiner* — Robert Beatty
(74) *Attorney, Agent, or Firm* — Venable LLP

(57) ABSTRACT

An image forming apparatus includes an image bearing member, a developing device that develops an electrostatic latent image formed on the image bearing member, a toner bottle having a storage portion storing the toner and a discharge portion made of resin and discharging the toner stored in the toner storage portion, and an attachment portion attached with the toner bottle. A driving portion drives the storage portion, a controller controls the driving portion, and a memory disposed in the toner bottle memorizes information regarding component dimensions of a molded discharge portion of the toner bottle. An information reading portion reads information regarding the component dimensions of the molded discharge portion, and the controller controls the driving portion so that a discharge amount of the toner from the discharge portion becomes a specific toner amount targeted based on the information regarding the component dimensions of the molded discharge portion.

3 Claims, 20 Drawing Sheets

(56) References Cited

U.S. PATENT DOCUMENTS

| | | | | |
|---|---|---|---|---|
| 2002/0025173 | A1* | 2/2002 | Isobe | G03G 15/553 399/12 |
| 2016/0004182 | A1 | 1/2016 | Yago et al. | |
| 2016/0004187 | A1 | 1/2016 | Yomoda et al. | |

FOREIGN PATENT DOCUMENTS

| | | | | |
|---|---|---|---|---|
| JP | 2011-085898 | A | | 4/2011 |
| JP | 2011164390 | A | * | 8/2011 |
| JP | 2012-141561 | A | | 7/2012 |
| JP | 2013-037091 | A | | 2/2013 |
| JP | 2014-186138 | A | | 10/2014 |

* cited by examiner

IMAGE FORMING APPARATUS HAVING CONTROLLED TONER DISCHARGE AMOUNT

BACKGROUND OF THE INVENTION

Field of the Invention

The present invention relates to a developer supply device that supplies developer from a developer supply container which is detachably attached and an image forming apparatus including the developer supply device.

Description of the Related Art

In the related art, image forming apparatuses such as an electrophotographic copying machine have employed a system in which an electrostatic latent image formed on a surface of a photosensitive member is developed as a toner image using a development device and the toner image is transferred to a printing medium such as a sheet of paper and is fixed by using a fixing portion to acquire a printed image.

An image forming apparatus of a two-component development scheme has employed a system in which developer in a development device includes toner and carrier, is frictionally charged by agitating both components with a screw, and is transferred to a photosensitive member with an electrical force.

In the image forming apparatus of a two-component development scheme, a variation in ratio of toner and carrier (a variation in toner density) causes a variation in frictional charging amount of the toner, the variation in frictional charging amount of the toner causes a variation in toner image density of the photosensitive member, and the variation in toner image density causes a variation in output image density on a printing medium which is finally output. Accordingly, in order to keep the image density constant, it is necessary to keep toner density constant by appropriately controlling a supplied toner quantity.

In toner supply control, in order to supply a target toner quantity, supply capability of a toner supply portion is ascertained in advance and a driving time of the toner supply portion is determined to supply the target toner quantity calculated based on the supply capability.

However, the actual supply capability of the toner supply portion is likely to vary for various factors such as component tolerance of the toner supply portion and physical properties of the toner, the actual supplied toner quantity does not reach a target supplied toner quantity to cause a supply error, and there is thus a problem in that the toner density varies.

In Japanese Patent Laid-Open No. 2013-037091, attention is paid to a variation in fluidity of supplied toner as one factor for a variation in supplied toner quantity. In general, a bulk density is high when the fluidity of toner is high, and the bulk density is low when the fluidity is low. Accordingly, when toner with a constant volume is supplied, the supplied toner quantity varies due to a variation in bulk density. When a toner supply portion is activated, the fluidity of toner increases. Therefore, an image forming apparatus that suppress a supply error by correcting a driving time of a toner supply portion that supplies toner based on a driving duty of the toner supply portion is disclosed.

In Japanese Patent Laid-Open No. 2009-223144, a toner supply portion that supplies toner using a toner supply pump is disclosed. The toner supply portion includes a correction portion that stores a toner supply time in an ID chip included in a toner cartridge and corrects a predetermined supplied toner quantity depending on an interval from the previous toner supply time.

However, in a configuration in which developer is supplied directly from a developer supply container to a developing device, an influence of variation factors of characteristics of the developer supply container or characteristics of developer increases.

For example, a variation in fluidity of toner due to manufacturing fluctuation (in an amount of external additive, grain size, and the like) is a dominant factor for fluidity of one toner container, and an amount of toner discharged from the developer supply container varies for every replacement of the developer supply container.

In a supply configuration in which supplied toner quantity accuracy is determined by the developer supply container, an amount of toner discharged from the developer supply container varies due to manufacturing fluctuation based on a mechanical error of the developer supply container, and the amount of toner discharged from the developer supply container varies for every replacement of the developer supply container.

SUMMARY OF THE INVENTION

The invention provides an image forming apparatus that can decrease a variation in an amount of toner discharged from a developer supply container which is caused by a variation in characteristics of developer or the developer supply container.

The invention also provides an image forming apparatus including:

an image bearing member;

a developing device that develops an electrostatic latent image formed on the image bearing member;

an attachment portion to which a developer supply container containing developer is attached;

an information reading portion that reads information on the developer supply container stored in an information storage portion disposed in the developer supply container;

a conveyance portion that communicates with a discharge port for discharging developer of the developer supply container and the developing device and conveys developer discharged from the developer supply container attached to the attachment portion to the developing device;

a discharge mechanism that discharges developer from the developer supply container; and a controller that controls an operation of the discharge mechanism to reach a set discharged developer quantity using the information read by the information reading portion.

Further features of the present invention will become apparent from the following description of exemplary embodiments with reference to the attached drawings.

DESCRIPTION OF THE EMBODIMENTS

Hereinafter, embodiments of the invention will be described in detail with reference to the accompanying drawings. The below-described embodiments are exemplary embodiments of the invention and thus are technically preferably defined. However, the scope of the invention is not limited to the embodiments unless particularly mentioned to limit the invention.

First Embodiment

<Image Forming Apparatus>

Figure 1:
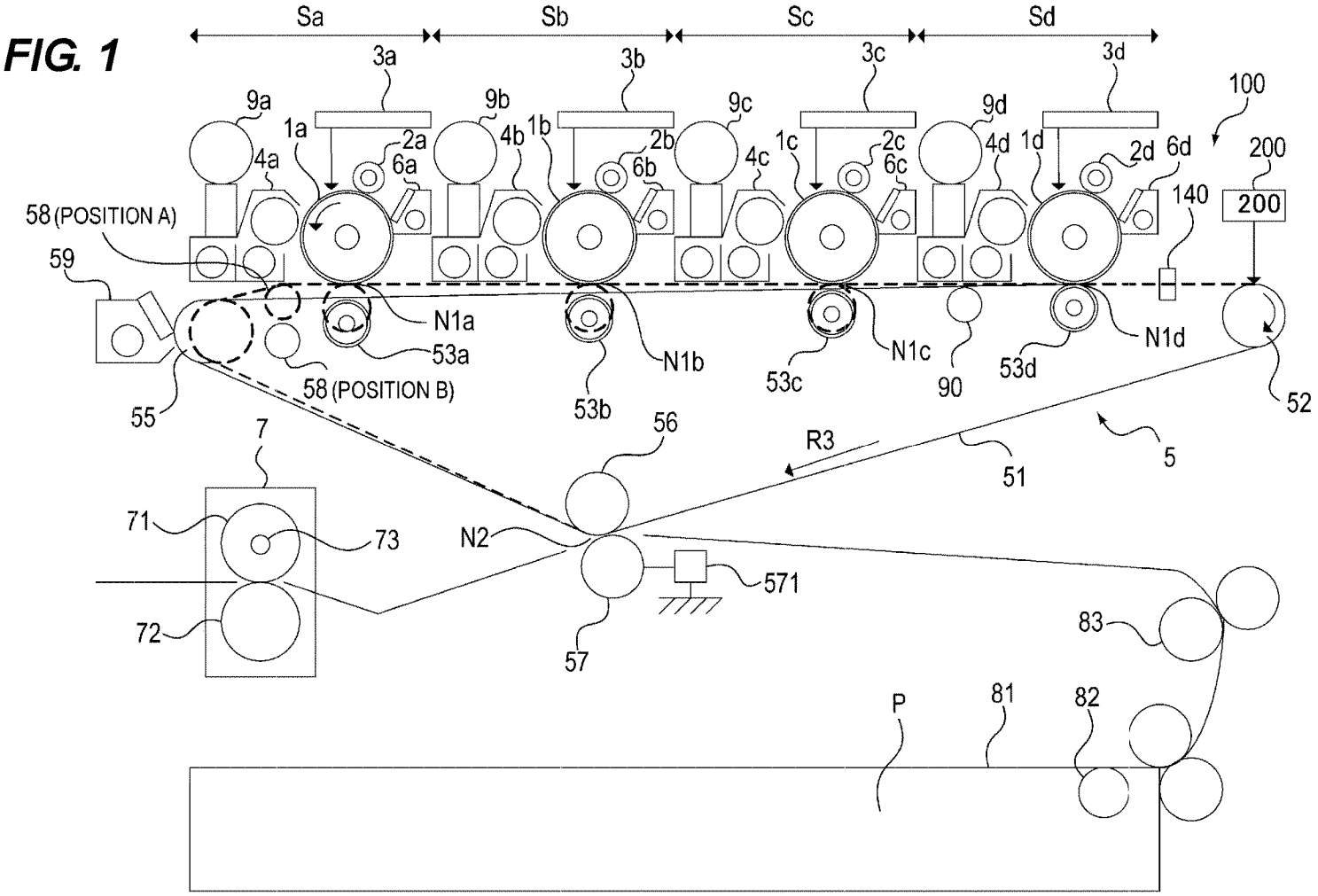
FIG. 1 is a cross-sectional view schematically illustrating an image forming apparatus according to an embodiment of the invention.

First, the entire configuration and operation of an image forming apparatus including a developer supply device according to the invention will be described. FIG. 1 illustrates a schematic cross-sectional configuration of an image forming apparatus 100 according to a first embodiment of the invention. The image forming apparatus 100 according to this embodiment is a full-color electrophotographic image forming apparatus including four photosensitive drums and employing an intermediate transfer system. In this embodiment, a process speed corresponding to a surface moving velocity of a photosensitive drum 1 and an intermediate transfer belt 51 is 150 mm/sec.

The image forming apparatus 100 includes first, second, third, and fourth image forming portions (process units) Sa, Sb, Sc, and Sd as a plurality of image forming portions. The image forming portions Sa, Sb, Sc, and Sd are to form colors of yellow (Y), magenta (M), cyan (C), and black (Bk), respectively. In this embodiment, the configurations of the image forming portions Sa to Sd are substantially the same, except that colors of toner are different. Accordingly, unless particularly distinguishment is required, subscripts a, b, c, and d which are added to reference signs to represent for what colors elements are provided will be omitted and general description will be made.

The image forming portion S includes a photosensitive drum 1 as an image bearing member. A charging roller 2 as a primary charging portion, a laser scanner 3 as an exposing portion, a developing device 4 as a developing portion, a drum cleaner 6 as a drum cleaning portion, and the like are sequentially arranged around the photosensitive drum 1 in a rotating direction of the photosensitive drum 1. A circulatable belt member as an intermediate transfer member, that is, an intermediate transfer belt 51, is disposed adjacent to the photosensitive drums 1*a* to 1*d* of the image forming portions Sa to Sd.

The intermediate transfer belt 51 is suspended on a driving roller 52, a steering roller 55, a secondary transfer inner roller 56, and an upstream regulating roller 58 as a plurality of support members. The steering roller 55 also has a function of giving a tension for stretching the intermediate transfer belt 51, and both ends of the steering roller 55 are impelled substantially to the left in FIG. 1 by a spring impelling mechanism which is not illustrated. The intermediate transfer belt 51 is supplied with a driving force by the driving roller 52 as a belt driving mechanism and circulates in a direction of arrow R3 in the drawing.

Primary transfer rollers 53*a* to 53*d* as a primary transfer member are disposed at positions on the inner circumferential surface of the intermediate transfer belt 51 facing the photosensitive drums 1*a* to 1*d*. The primary transfer rollers 53*a* to 53*d* are impelled to the photosensitive drums 1*a* to 1*d* with the intermediate transfer belt 51 interposed therebetween, to form primary transfer portions (primary transfer nips) N1*a* to N1*d* in which the photosensitive drums 1*a* to 1*d* and the intermediate transfer belt 51 come in contact with each other.

A secondary transfer outer roller 57 as a secondary transfer member is disposed at a position on the outer circumferential surface of the intermediate transfer belt 51 facing the secondary transfer inner roller 56. The secondary transfer outer roller 57 comes in contact with the outer circumferential surface of the intermediate transfer belt 51 to form a secondary transfer portion (a secondary transfer nip) N2.

Images on the photosensitive drums 1*a* to 1*d* which are formed in the image forming portions Sa to Sd are sequentially multiply transferred onto the intermediate transfer belt 51 passing by the photosensitive drums 1*a* to 1*d*. Thereafter, the images transferred onto the intermediate transfer belt 51 are additionally transferred to a transfer medium P such as a sheet of paper in the secondary transfer portion N2.

A fixing device 7 includes a fixing roller 71 that is rotatably disposed and a pressure roller 72 that rotates while coming in press contact with the fixing roller 71. A heater 73 such as a halogen lamp is disposed in the fixing roller 71. The surface temperature of the fixing roller 71 is adjusted by controlling a voltage supplied to the heater 73 or the like. When a transfer medium P is conveyed to the fixing device 7 and the transfer medium P passes between the fixing roller 71 and the pressure roller 72, the transfer medium P is pressurized and heated with almost constant pressure and temperature from both surfaces thereof. Accordingly, an unfixed toner image on the surface of the transfer medium P is melted and fixed to the transfer medium P. In this way, a full-color image is formed on the transfer medium P.

<Image Forming Portion>

Figure 2:
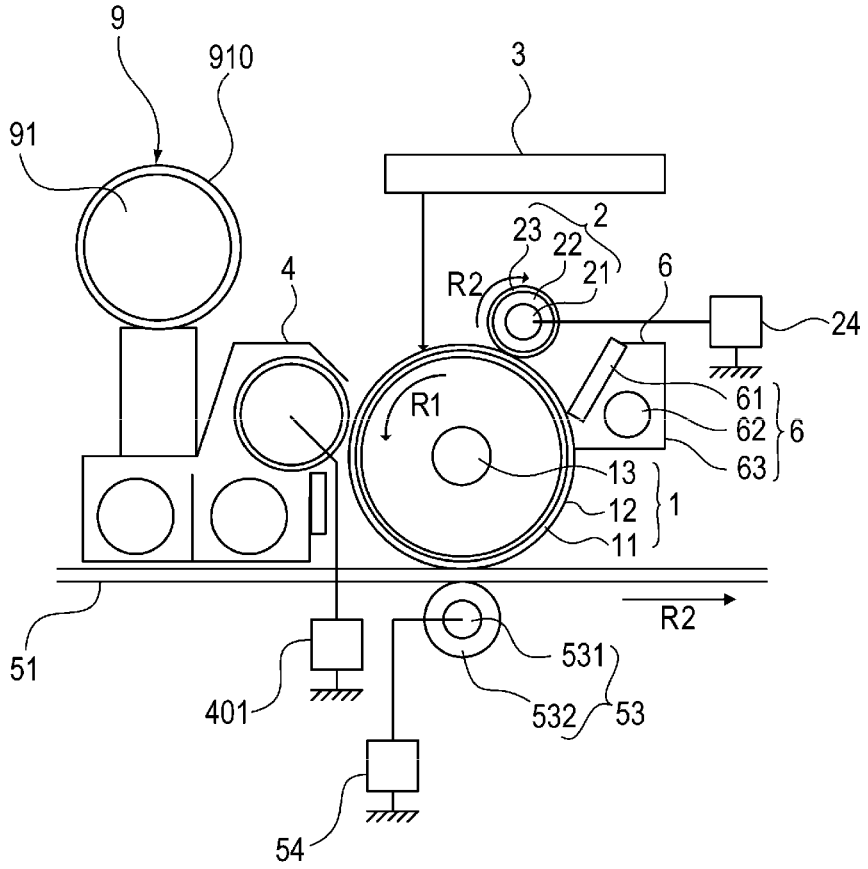
FIG. 2 is a cross-sectional view schematically illustrating a process unit according to the embodiment of the invention.

Details of the image forming portion S are illustrated in FIG. 2. Referring to FIG. 2, the photosensitive drum 1 is rotatably supported by an image forming apparatus body. The photosensitive drum 1 is a cylindrical electrophotographic photosensitive drum basically including a conductive substrate 11 of aluminum or the like and a photoconductive layer 12 formed on the outer circumference thereof. The photosensitive drum 1 has a spindle 13 at the center thereof. The photosensitive drum 1 is rotationally driven in a direction of arrow R1 in the drawing about the spindle 13 by a driving mechanism (not illustrated). In this embodiment, an organic photosemiconductor photosensitive drum with ϕ30 is used, but an amorphous silicon-based photosensitive drum may be used.

A charging roller 2 as a primary charging portion is disposed above the photosensitive drum 1 in the drawing. The charging roller 2 comes in contact with the surface of the photosensitive drum 1 and uniformly charges the surface of the photosensitive drum 1 to a predetermined polarity and a predetermined potential. The charging roller 2 includes a conductive core 21 disposed at the center, a low-resistance conductive layer 22 formed on the outer circumference thereof, and a middle-resistance conductive layer 23, and has a roller shape as a whole. Both ends of the core 21 in the charging roller 2 are rotatably supported by bearing members (not illustrated) and the charging roller is disposed parallel to the photosensitive drum 1. The bearing members at both ends thereof are impelled to the photosensitive drum 1 by a pressing mechanism (not illustrated). Accordingly, the charging roller 2 comes in press contact with the surface of the photosensitive drum 1 with a predetermined pressing force. The charging roller 2 rotates in the direction of arrow R2 in the drawing to follow the rotation in the direction of arrow R1 of the photosensitive drum 1. A charging bias voltage is applied to the charging roller 2 by a charging bias power supply 24 as a charging bias output portion. Accordingly, the surface of the photosensitive drum 1 in this embodiment is uniformly charged to −600 V.

The laser scanner 3 is disposed downstream from the charging roller 2 in the rotating direction of the photosensitive drum 1. The laser scanner 3 scans the photosensitive drum 1 while turning on/off a laser beam based on image information to expose the photosensitive drum 1. Accordingly, an electrostatic image (latent image) based on the image information is formed on the photosensitive drum 1. The wavelength of the laser scanner which is used in this embodiment is λ=780 nm and the resolution thereof is 600 dpi.

The developing device 4 is disposed downstream from the laser scanner 3 in the rotating direction of the photosensitive drum 1. Details of the developing device 4 that develops the electrostatic image formed on the photosensitive drum 1 and a supply device 9 that supplies toner to the developing device 4 will be described later.

The primary transfer roller 53 is disposed below the photosensitive drum 1 in the drawing, downstream from the developing device 4 in the rotating direction of the photosensitive drum 1. The primary transfer roller 53 includes a core 531 and a conductive layer 532 formed in a cylindrical shape on the outer circumferential surface thereof. Both ends of the primary transfer roller 53 are impelled to the photosensitive drum 1 by a pressing member (not illustrated) such as a spring. Accordingly, the conductive layer 532 of the primary transfer roller 53 comes in press contact with the surface of the photosensitive drum 1 with the intermediate transfer belt 51 interposed therebetween with a predetermined pressing force. A primary transfer bias power supply 54 as a primary transfer bias output portion is connected to the core 531. The primary transfer portion N1 is formed between the photosensitive drum 1 and the primary transfer roller 53. The intermediate transfer belt 51 is inserted into the primary transfer portion N1. The primary transfer roller 53 comes in contact with the inner circumferential surface of the intermediate transfer belt 51 and rotates with the movement of the intermediate transfer belt 51. At the time of forming an image, a primary transfer bias voltage with a polarity (a second polarity: a positive polarity in this embodiment) opposite to a normal charging polarity (a first polarity: a negative polarity in this embodiment) is applied to the primary transfer roller 53 by the primary transfer bias power supply 54. An electric field in a direction in which toner with the first polarity is moved from the photosensitive drum 1 to the intermediate transfer belt 51 is formed between the primary transfer roller 53 and the photosensitive drum 1. Accordingly, the toner image on the photosensitive drum 1 is transferred (primarily transferred) to the surface of the intermediate transfer belt 51.

Extraneous matter such as toner (primary transfer residual toner) remaining on the surface of the photosensitive drum 1 after the primary transfer process is cleaned by the drum cleaner 6. The drum cleaner 6 includes a cleaning blade 61 as a drum cleaning member, a conveyance screw 62, and a drum cleaner housing 63. The cleaning blade 61 comes in contact with the photosensitive drum 1 with a predetermined angle and a predetermined pressure by a pressing mechanism (not illustrated). Accordingly, toner or the like remaining on the surface of the photosensitive drum 1 is scraped out and removed from the photosensitive drum 1 by the cleaning blade 61 and is recovered in the drum cleaner housing 63. The recovered toner or the like is conveyed by the conveyance screw 62 and is discharged to a waste toner container (not illustrated).

<Developing Device>

Figure 3A:
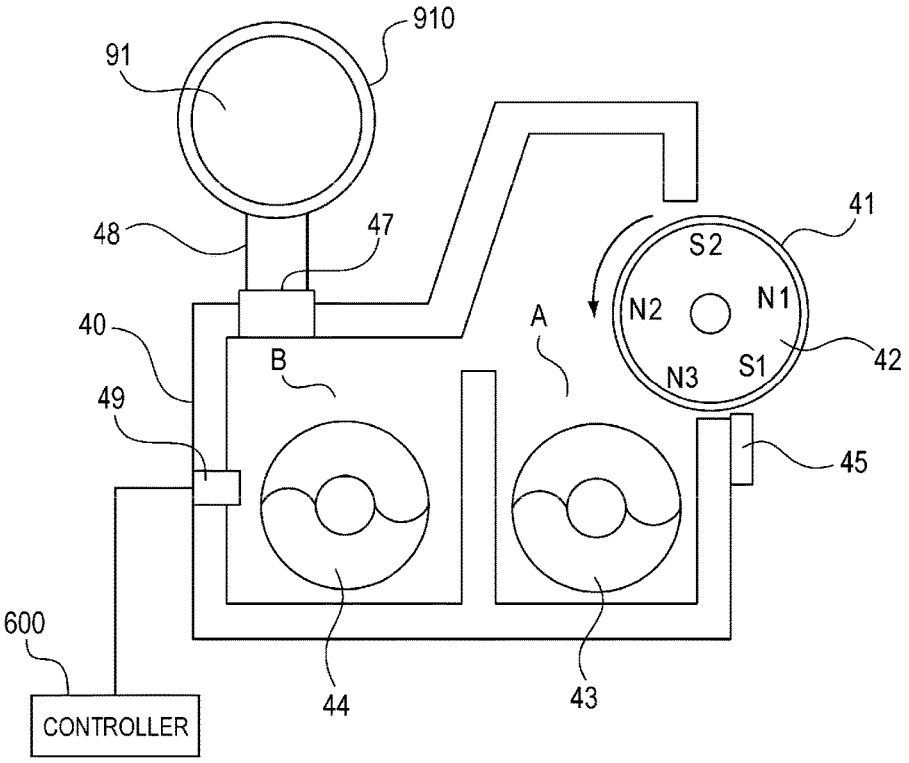
FIGS. 3A and 3B are diagrams schematically illustrating a developing device according to the embodiment of the invention.
Figure 3B:
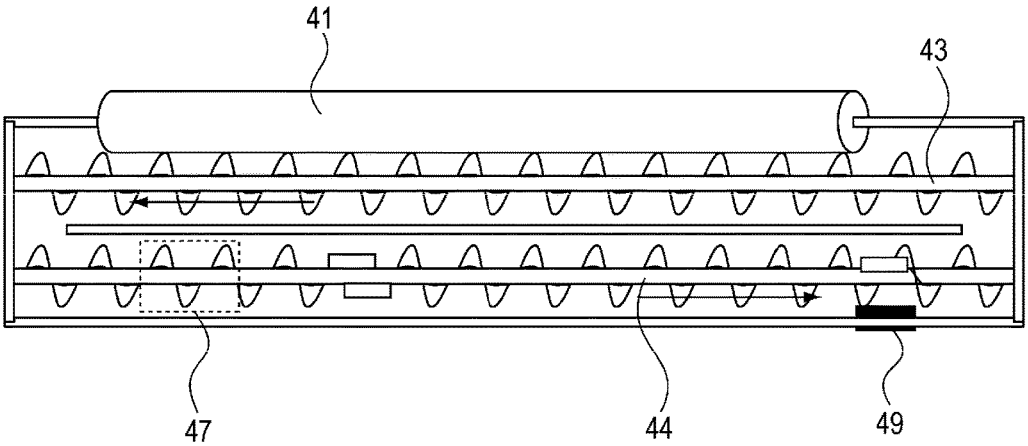

The developing device 4 will be described below in detail with reference to FIGS. 3A and 3B. FIGS. 3A and 3B are a cross-sectional view and a top view of the developing device 4.

Two-component developer including nonmagnetic toner and magnetic carrier is contained in a developing container 40 of the developing device 4, a weight ratio of nonmagnetic toner to the two-component developer, that is, a toner density, is about 10 wt %. This ratio can be appropriately adjusted depending on a charging amount, a carrier particle diameter, or a configuration of the image forming apparatus, or a use state, or the like and is not limited to the numerical value.

As the magnetic carrier, for example, metals such as surface-oxidized or non-oxidized iron, nickel, cobalt, manganese, chromium, or rare earth metals, alloys thereof, or ferrite oxides can be suitably used, and a method of manufacturing such magnetic particles is not particularly limited. Carrier obtained by coating ferrite particles with silicon resin is used as the magnetic carrier in this embodiment. The magnetic carrier has specific resistance of $1\times10^{7-8}$ Ω·cm at a field intensity of 3000 V/cm when the saturated magnetization with respect to an applied magnetic field of 240 kA/m is 294 $am^2$/kg. In addition, resin magnetic carrier which is manufactured by a polarization method using binder resin, magnetic metal oxide, and nonmagnetic metal oxide as starting materials may be used as the magnetic carrier.

A volume average particle diameter of the magnetic carrier is measured using a laser-diffraction grain size distribution measuring device HEROS (manufactured by JEOL Ltd.). First, particles in a particle diameter range of 0.5 μm to 350 μm are partitioned and measured in 32 channels in terms of volume, and the number of particles in each channel is measured. A median diameter of volume 50% from the measurement result is set as the volume average particle diameter. In this embodiment, the volume average particle diameter of the magnetic carrier is 50 μm.

The nonmagnetic toner includes at least a binder, a colorant, and a charging control agent. In this embodiment, a styrene acrylic resin is used as the binder resin, but a resin such as a styrene-based resin, a polyester-based resin, or polyethylene-based resin can be used. In this embodiment, phthalocyanine blue is used as the colorant, but various pigments or various dyes such as carbon black, chrome yellow, Hansa yellow, benzidine yellow, threne yellow, quinolone yellow, permanent orange GTR, pyrazolone orange, vulcan orange, watch young red, permanent red, brilliant carmine 3B, brilliant carmine 6B, Du Pont oil red, pyrazolone red, lithol red, rhodamine B lake, lake red C, rose Bengal, aniline blue, ultramarine blue, chalco oil blue, methylene blue chloride, phthalocyanine green, and malachite green oxalate may be used alone as the colorant or a plurality of types of colorants may be used together.

The charging control agent may contain a charging control agent for reinforcement if necessary. All known ones can be used as the charging control agent for reinforcement. Examples thereof include a nigrosine dye, a triphenylmethane dye, a chromium-containing metal complex dye, a molybdic chelate pigment, a rhodamine-based dye, an alkoxy-based amine, a quaternary ammonium salt (which includes a fluorine-modified quaternary ammonium salt), alkylamide, a simple substance or compound of phosphorous, a simple substance or compound of tungsten, a fluorine-based activator, a salicylic acid metal salt, and a salicylic acid derivative metal salt.

The nonmagnetic toner may include wax or external additive. The wax is contained to improve toner parting properties from the fixing member and fixability at the time of fixing. Paraffin wax, carnauba wax, polyolefin, or the like can be used as the wax, which is kneaded and dispersed in the binder resin for use. In this embodiment, particles obtained by pulverizing a resin in which the binder, the colorant, the charging control agent, and the wax are dispersed using a mechanical pulverizer.

Examples of external additive particles include particulates obtained by performing hydrophobic treatment on amorphous silica and inorganic oxide particulates of titanium oxide, titanium compound, and the like. By externally adding the particulates to a toner base, power fluidity or a charging amount of toner can be suitably controlled. It is desirable that the diameter of the external additive particles range from about 1 nm to about 100 nm. In this embodiment, titanium oxide with an average particle diameter of 50 nm is externally added at a weight ratio of 0.5 wt % and amorphous silica with an average particle diameter of 2 nm and 100 nm is externally added at weight ratios of 0.5 wt % and 1.0 wt %.

The particle diameters of the toner having the above-mentioned configuration were measured to be 6.0 μm in volume average particle diameter by a powder grain size image analyzer FPIA-3000 manufactured by SYSMEX CORPORATION. The cohesion of the toner was measured to be 30 by a powder tester manufactured by HOSOKAWA MICRON CORPORATION.

In this embodiment, 200 g of developer D in which the toner and the carrier are mixed at a mixing ratio (a toner density) of 10 wt % is input to the developing device.

In the developing device 4, a developing area facing the photosensitive drum 1 is opened, and a developing sleeve 41 is rotatably disposed to be partially exposed to the opening. The developing sleeve 41 includes a fixed magnet roll 42 which is a magnetic field generator. When the developing operation is performed, the developing sleeve 41 rotates in an arrow direction of the drawing, holds the developer in the developing container in a layered manner, bears and conveys the developer to the developing area, supplies the developer to the developing area facing the photosensitive drum 1, and develops an electrostatic latent image formed on the photosensitive drum 1 using the toner. The developer after the electrostatic latent image is developed is conveyed with rotation of the developing sleeve 41 and is recovered into the developing container. Then, the developer circulates in the developing container by a developing screw 43 as a first developer agitating and conveyance member disposed in a developing chamber A of the developing container 40 and an agitating screw 44 as a second developer agitating and conveyance member disposed in an agitating chamber B, and are mixed and agitated again. The circulating direction of the developer is a direction from the near side to the deep side in FIG. 3A on the developing screw 43 side and a direction from the deep side to the near side on the agitating screw 44 side. The developing screw 43 and the agitating screw 44 have a spindle diameter of 7 mm and an outer size of 14 mm and the rotating speed thereof is set to 300 rpm. The distance between the developing container and the screws is set to 1 mm.

In this embodiment, the developing sleeve 41 is disposed to face the photosensitive drum 1 with a gap of 300 μm therebetween, and is disposed to be rotatable in the same direction (the arrow direction in the drawing) as the rotating direction of the photosensitive drum 1 at 180% of the circumferential speed of the photosensitive drum 1. The developing sleeve 41 is formed of metal such as aluminum or SUS in a cylindrical shape and the surface thereof is subjected to a blast process or the surface is subjected to a plating process or a coating process, whereby conveyability and frictional chargeability of developer is adjusted. In this embodiment, a metal sleeve in which an aluminum surface is subjected to a blast process is used.

A magnet roll 42 having a plurality of magnetic poles as a magnetic field generator is fixed and disposed in the developing sleeve 41. In this embodiment, the magnet roll 42 in which five poles are magnetized is used. An S1 pole is a developer quantity regulating pole that regulates a developer quantity conveyed to the developing area. An N1 pole is a developing pole that contributes to development. An S2 pole is a conveying pole that conveys the developer. An N2 pole is a repulsing pole that scrapes out the developer borne on the developing sleeve. An N3 pole is an uptake pole that causes the developing sleeve 41 to bear the developer sent from the developing screw 43.

In this embodiment, a developer quantity regulating member is disposed to face the developing sleeve 41 with a constant gap therebetween over the length direction of a nonmagnetic blade 45 having a plate shape with a thickness of 1 mm. The shape of the nonmagnetic blade 45 is not limited to the plate shape, but the tip thereof may be sharpened with a thickness of about 0.3 mm. The developer borne on the developing sleeve 41 is uniformized and conveyed to the developing area, depending on the shape of the nonmagnetic blade, the gap between the developing sleeve 41 and the nonmagnetic blade 45, and the size and angle of the developer quantity regulating pole S1. In this embodiment, the gap between the developing sleeve 41 and the nonmagnetic blade 45 is set to 300 μm and the developer quantity conveyed to the developing area is regulated to 30 $mg/cm^2$ in mass per unit area (M/S).

According to this configuration, the developer in the developing device 4 is borne by the developing sleeve 41 including the magnet roll 42, is conveyed to the position facing the photosensitive drum 1, and forms a magnetic brush at the position facing the photosensitive drum 1. By applying a developing bias suitable for the developing sleeve 41, the electrostatic latent image on the photosensitive drum 1 is developed. In this embodiment a voltage in which an AC component with a frequency of 10 kHz and an inter-peak voltage Vpp of 1.8 kV and a DC component (Vdc) of −450 V are superimposed is applied from a high-voltage power supply 401, but the invention is not limited to the numerical values.

In this embodiment, a permeability sensor is used as a toner density sensor (a sensor) 49 that detects a mixing ratio of the toner and the magnetic carrier in the developer in the developing device. The permeability sensor determines a toner density by detecting a variation in apparent permeability (detecting inductance) of the developer which decreases with an increase in the toner density of the developer. In this embodiment, as illustrated in FIG. 3B, the toner density sensor is disposed at a position downstream in the agitating chamber B and on a side surface of the developing device. The toner density sensor is suitably disposed at a position at which the developer sufficient for detecting permeability is always present. The position is determined such that the developer present in the area which is detected by the permeability sensor is always subjected to an agitating action by the agitating screw 44. The detected value of the toner density sensor is output to a supply control portion which is controlled by a CPU (controller) 600.

In calculating the toner density, a plurality of output values of the permeability sensor is sampled and averaged and a vibration component due to the rotation cycle of the agitating screw 44 is cancelled to extract the DC component of the output value of the permeability sensor. The toner density is calculated by referring to a table which is prepared in advance by checking the relationship between the value and the toner density.

A video count type counter (see FIG. 16) which is a consumed toner quantity calculating mechanism of each image is also provided, and the level of an output signal of an image signal processing circuit which is not illustrated is counted for each pixel. The level is integrated by the counter for each pixel, and the video count value of each image is calculated. The video count value corresponds to a toner quantity consumed from the developing device 4 to form one toner image of each image.

Based on the output of the toner density sensor 49, the video count value, and information specific to the developer supply container, the CPU 600 determines a supplied quantity using a toner supply control method to be described later and supplies a predetermined amount of toner to the developing device 4 by a toner supply mechanism (a developer supply device) to be described later.

<Toner Supply Mechanism>

A toner supply mechanism (a supply device 9) in this embodiment will be described below with reference to FIGS. 3A to 10B. A developer supply container 91 illustrated in FIG. 3A can be easily attached to and detached from an attachment portion 910 of the image forming apparatus. The attachment portion 910 includes a developer receiving port (a developer receiving hole) 913 that communicates with a discharge port (discharge hole) 94*a* (see FIG. 5) of the developer supply container 91 to be described later and receives developer discharged from the developer supply container 91 when the developer supply container 91 is attached thereto. The developer is supplied from the discharge port 94*a* of the developer supply container 91 to the developing device 4 via the developer receiving port 913. In this embodiment, the diameter ϕ of the developer receiving port 913 is set to about 3 mm of a fine hole (pinhole) for the purpose of preventing contamination in the attachment portion due to the developer. The diameter of the developer receiving port is not particularly limited as long as it can discharge developer from the discharge port 94*a*.

Figure 4A:
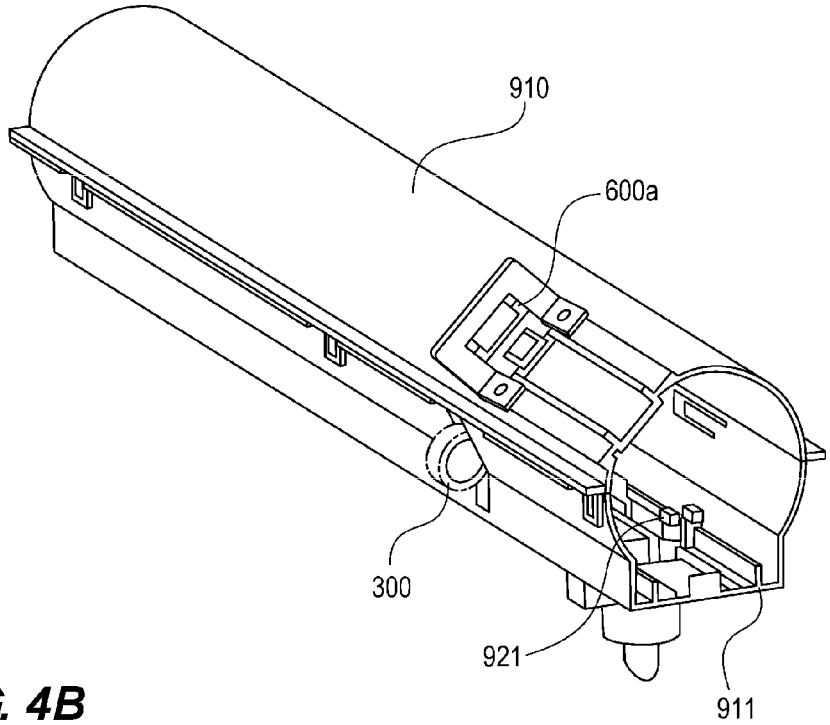
FIGS. 4A and 4B are a partial cross-sectional view and a perspective view of an attachment portion of a developer supply device according to the embodiment of the invention.
Figure 4B:
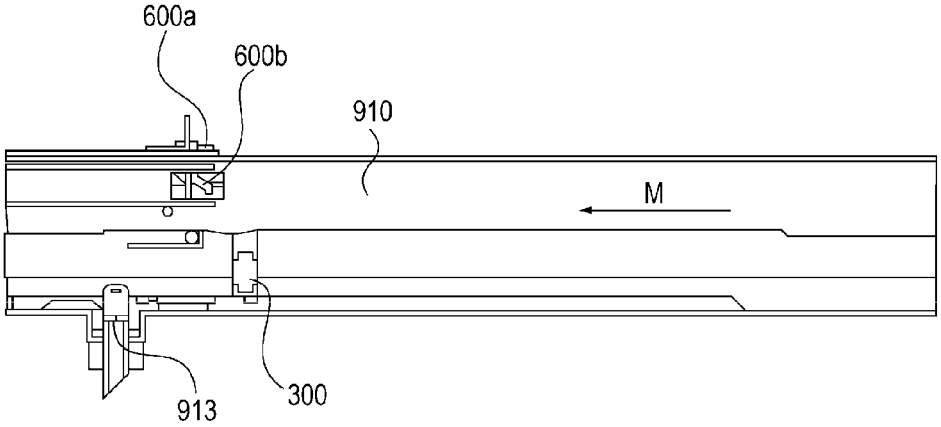

The attachment portion 910 includes a driving gear 300 serving as a driving mechanism (a driving portion) as illustrated in FIGS. 4A and 4B. The driving gear 300 is supplied with a rotational driving force from a driving motor 500 (FIG. 5) via a driving gear train and has a function of transmitting the rotational driving force to the developer supply container 91 set in the attachment portion 910.

Figure 5:
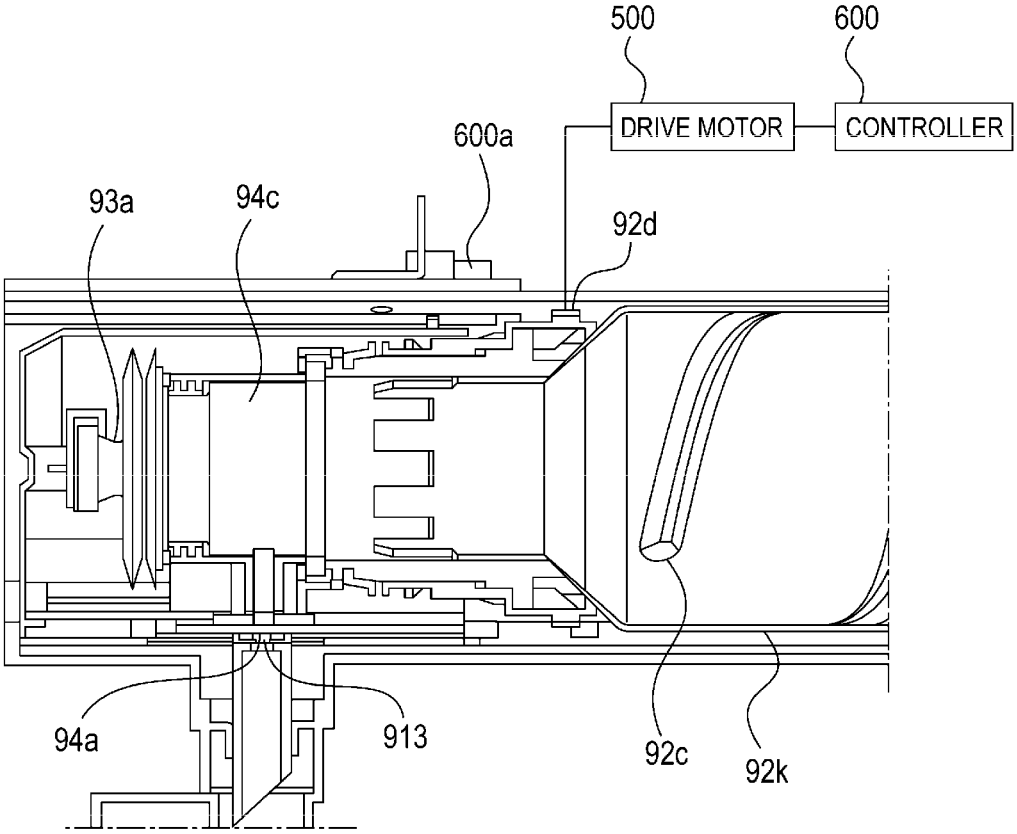
FIG. 5 is an enlarged cross-sectional view illustrating the developer supply device according to the embodiment of the invention.

The driving motor 500 is configured such that the operation thereof is controlled by a controller (CPU) 600 as illustrated in FIG. 5.

(Developer Supply Container)

Figure 6A:
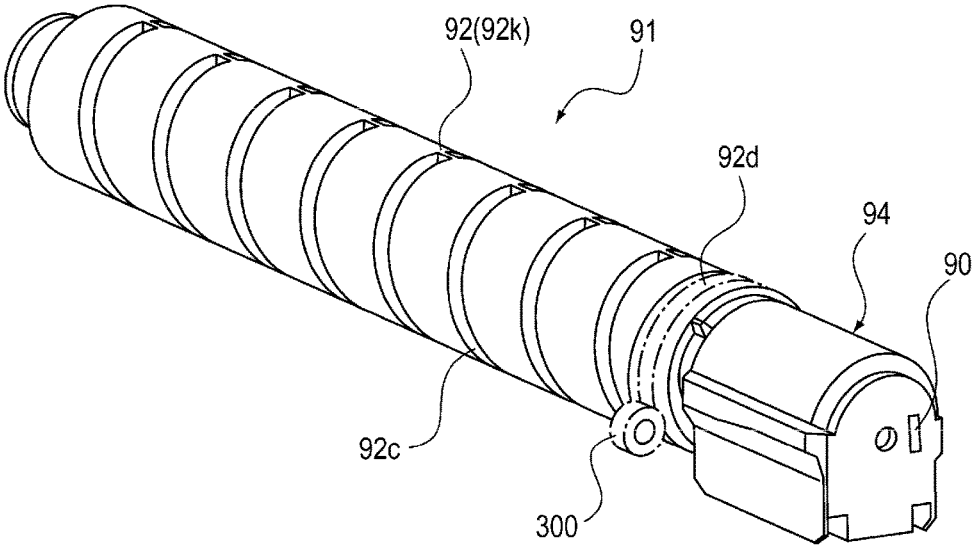
FIGS. 6A and 6B are a perspective view illustrating developer supply container according to the embodiment of the invention and a partial enlarged view illustrating an appearance around a discharge port.
Figure 6B:
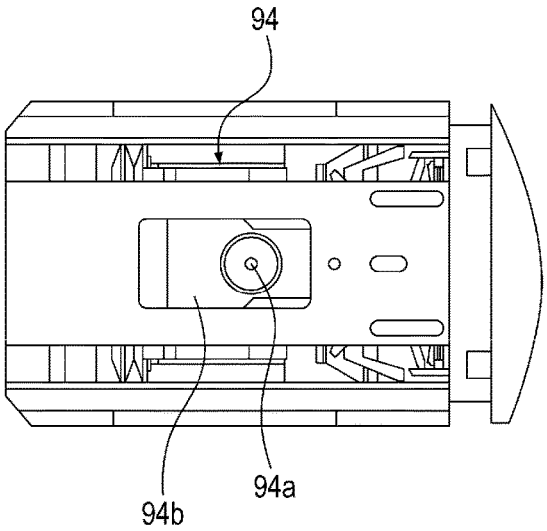
Figure 7:
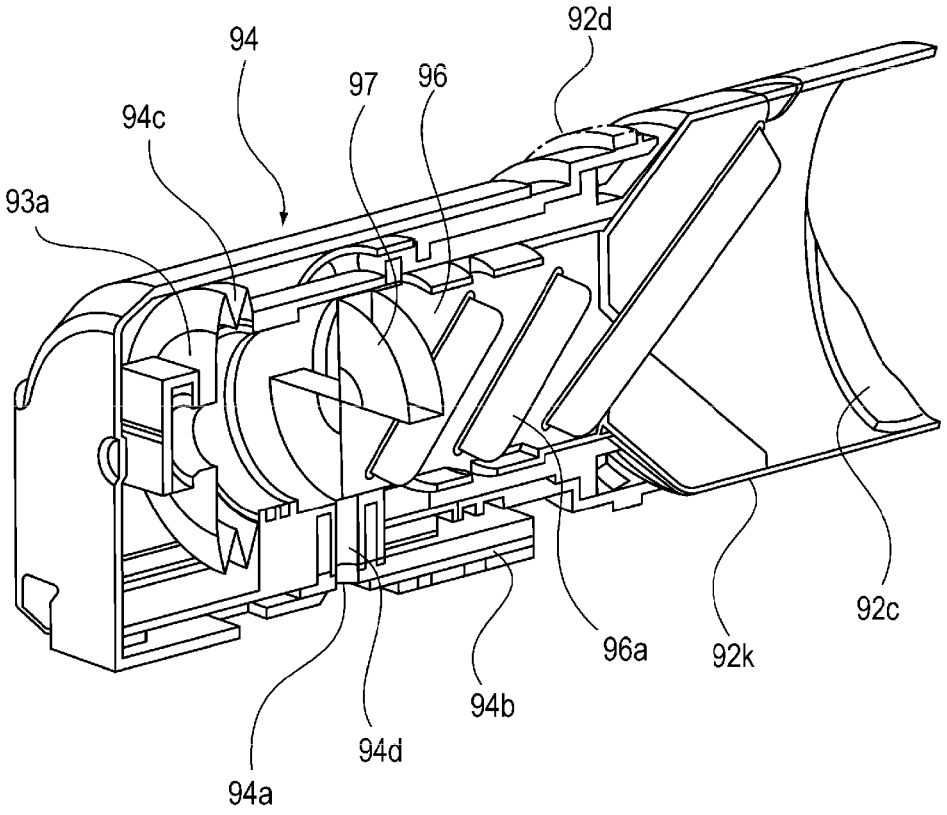
FIG. 7 is a cross-sectional perspective view of a developer supply container according to the embodiment of the invention.
Figure 8A:
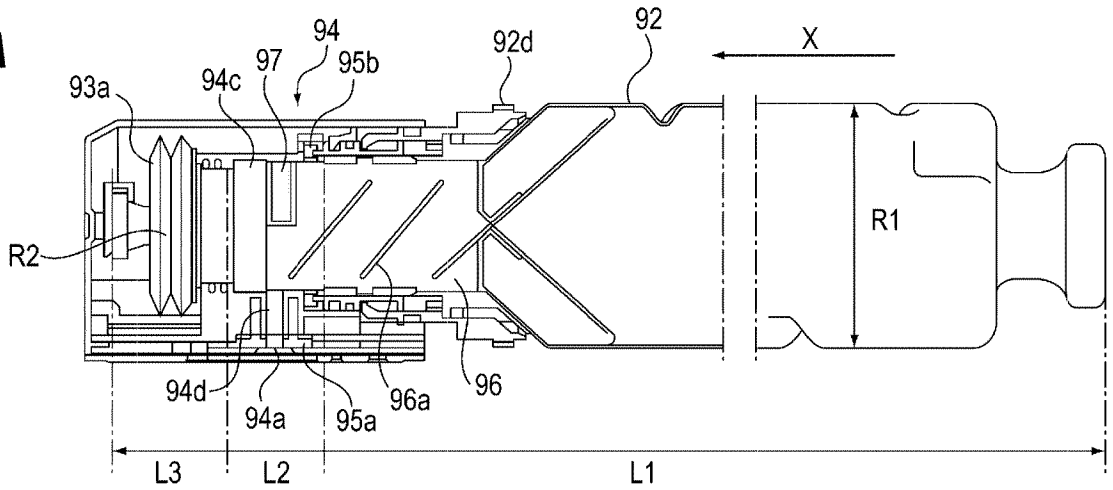
FIGS. 8A and 8B are partial cross-sectional views of the developer supply container according to the embodiment of the invention.
Figure 8B:
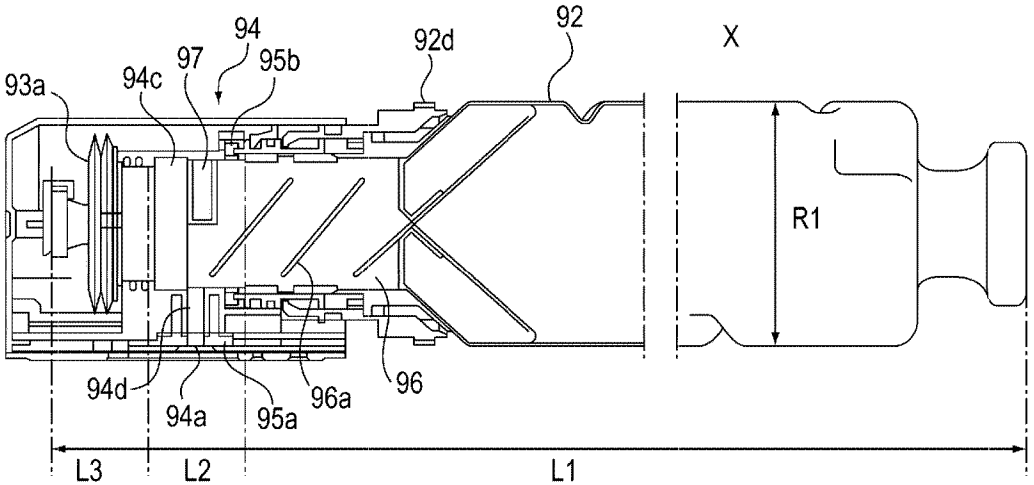

The configuration of the developer supply container 91 which is a constituent element of the developer supply system will be described below with reference to FIGS. 6A and 6B, FIG. 7, and FIGS. 8A and 8B. Here, FIG. 6A is a perspective view of the entire developer supply container 91 and FIG. 6B is a partial enlarged view of the periphery of the discharge port 94*a* of the developer supply container 91. FIG. 7 is a cross-sectional perspective view of the developer supply container. FIG. 8A is a partial cross-sectional view illustrating a state in which a pump portion is stretched as much as possible and FIG. 8B is a partial cross-sectional view illustrating a state in which the pump portion is shrunk as much as possible.

As illustrated in FIG. 6A, the developer supply container 91 includes a developer receiving portion 92 (which is also referred to as a container body) having a hollow cylindrical shape and having an internal space for receiving developer therein. In this example, a cylindrical portion 92*k*, a discharge portion 94*c* (see FIG. 5), and a pump portion 93*a* (see FIG. 5) serve as the developer receiving portion 92. The developer supply container 91 includes a flange portion 94 (which is also referred to as a non-rotating portion) at one end in a length direction of the developer receiving portion 92 (a developer conveying direction). The cylindrical portion 92*k* is configured to be rotatable relative to the flange portion 94. The cross-sectional shape of the cylindrical portion 92*k* may be set to a non-circular shape as long as it does not affect a rotating operation in a developer supply step. For example, the cross-section of the cylindrical portion may have an elliptical shape or a polygonal shape.

In this example, as illustrated in FIG. 8A, the total length L1 of the cylindrical portion 92*k* serving as a developer containing chamber is set to about 460 mm and an outer diameter R1 thereof is set to about 60 mm. The length L2 of the area in which the discharge portion 94*c* serving as a developer discharging chamber is installed is set to about 21 mm, and the total length L3 of the pump portion 93*a* (when the pump portion is most stretched in a stretchable range in use) is set to about 29 mm. As illustrated in FIG. 8B, the total length L4 of the pump portion 93*a* (when the pump portion is most shrunk in the stretchable range in use) is set to about 24 mm.

Now, configurations of the flange portion 94, the cylindrical portion 92*k*, the pump portion 93*a*, a driving receiving mechanism 92*d*, and a driving conversion mechanism 92*e* (a cam groove, see FIGS. 9A and 9B) of the developer supply container will be sequentially described in detail.

(Flange Portion)

As illustrated in FIG. 7, the flange portion 94 is provided with a hollow discharge portion (a developer discharging chamber) 94*c* for temporarily containing developer conveyed from the cylindrical portion 92*k*. In the bottom of the discharge portion 94*c*, a discharge port 94*a* allowing discharge of developer outside of the developer supply container 91, that is, supplying developer to the developing device 4, is formed. A communicating passage 94*d* that causes the discharge port 94*a* to communicate with the inside of the developer supply container 91 and that can contain a predetermined amount of developer before being discharged is disposed above the discharge port 94*a*. The communicating passage 94*d* also has a function of a developer storage portion that can store a predetermined amount of developer before being discharged. The discharge port 94*a* matches the developer receiving port 913 of the attachment portion 910 in position, both communicate with each other, and developer can be supplied from the developer supply container 91.

The flange portion 94 is configured not to substantially move when the developer supply container 91 is attached to the attachment portion 910 of the supply device 9 (see FIG. 2 and FIGS. 3A and 3B).

Accordingly, in a state in which the developer supply container 91 is attached to the supply device 9, the discharge portion 94*c* disposed in the flange portion 94 is substantially inhibited from rotating in the rotating direction of the cylindrical portion 92*k* (movement such backlash is permitted).

On the other hand, the cylindrical portion 92*k* is configured to rotate in the developer supply step without being regulated in the rotating direction by the supply device 9.

As illustrated in FIG. 7, a plate-shaped conveyance member 96 that conveys developer conveyed from the cylindrical portion 92*k* by a spiral protruding portion (conveyance protrusion) 92*c* to the discharge portion 94*c* is provided.

The conveyance member 96 is disposed to divide a partial area of the developer receiving portion 92 into substantially two parts and is configured to rotate along with the cylindrical portion 92*k*. A plurality of inclined ribs 96*a* inclined to the discharge portion 94*c* with respect to a rotational axis direction of the cylindrical portion 92*k* is disposed on both surfaces of the conveyance member 96. In this configuration, a regulating portion 97 is disposed at an end of the conveyance member 96. Details of the regulating portion 97 will be described later.

According to this configuration, developer conveyed by the conveyance protrusion 92*c* is scraped from the lower side to the upper side in the vertical direction by the plate-shaped conveyance member 96 with the rotation of the cylindrical portion 92*k*. Thereafter, with the further rotation of the cylindrical portion 92*k*, the developer slides down on the surface of the conveyance member 96 by its gravity and is sent to the discharge portion 94*c* by the inclined ribs 96*a*. In this configuration, the inclined ribs 96*a* are disposed on both surfaces of the conveyance member 96 such that the developer is sent to the discharge portion 94*c* whenever the cylindrical portion 92*k* rotates by half a turn.

(Cylindrical Portion)

The cylindrical portion 92*k* serving as the developer containing chamber will be described below with reference to FIGS. 6A and 6B, FIG. 7, and FIGS. 8A and 8B.

As illustrated in FIGS. 6A and 6B and FIG. 7, the inner surface of the cylindrical portion 92*k* is provided with the conveyance protrusion 92*c* that spirally protrudes and serves as a conveyance portion conveying the developer therein with the rotation of the cylindrical portion to the discharge portion 94*c* (the discharge port 94*a*) serving as a developer discharging chamber. The cylindrical portion 92*k* is formed of the above-mentioned resin using a blow molding method.

As illustrated in FIGS. 8A and 8B, the cylindrical portion 92*k* is fixed to be rotatable relative to the flange portion 94 in a state in which a flange seal 95*b* which is a ring-shaped seal member disposed on the inner surface of the flange portion 94 is shrunk.

Accordingly, since the cylindrical portion 92*k* rotates while sliding on the flange seal 95*b*, the developer does not leak during rotation and air-tightness is maintained. That is, exit and entrance of air via the discharge port 94*a* is appropriately performed and the volume of the developer supply container 91 can be changed to a desired state during supply.

(Pump Portion)

The (forward and backward movable) pump portion 93*a* of which the volume is variable with the forward and backward movement will be described below with reference to FIG. 7.

The pump portion 93*a* in this example serves as an intake/exhaust mechanism that alternately performs an intake operation and an exhaust operation via the discharge port 94*a*. In other words, the pump portion 93*a* serves as an air flow generating mechanism that alternately repeatedly generates an air flow to the inside of the developer supply container and an air flow to the outside of the developer supply container via the discharge port 94*a*.

The pump portion 93*a* is disposed in the direction of arrow X from the discharge portion 94*c* as illustrated in FIG. 8A. That is, the pump portion 93*a* along with the discharge portion 94*c* is disposed not to rotate in the rotating direction of the cylindrical portion 92*k*.

In this example, a volume-variable pump portion (a bellows-shaped pump) formed of a resin of which the volume is variable with the forward and backward movement is employed as the pump portion 93*a*. Specifically, as illustrated in FIG. 7 and FIGS. 8A and 8B, a bellows-shaped pump is employed and a "mountain fold" portion and a "valley fold" portion are alternately periodically formed. Accordingly, the pump portion 93*a* can alternately repeatedly perform shrinkage and stretch by a driving force received from the supply device 9. In this example, a volume variation in stretching and shrinking of the pump portion 93*a* is set to 5 $cm^3$ (cc). L3 illustrated in FIG. 8A is set to about 29 mm, and L4 illustrated in FIG. 8B is set to about 24 mm. The outer diameter R2 of the pump portion 93*a* is set to about 45 mm.

By employing this pump portion 93*a*, the volume of the developer supply container 91 is variable and can be alternately repeatedly changed with a predetermined cycle. As a result, it is possible to efficiently discharge developer in the discharge portion 94*c* from the discharge port 94*a* with a small diameter (with a diameter of about 2 mm).

(Driving Receiving Mechanism)

A driving receiving mechanism (a driving receiving portion, a driving force receiving portion) of the developer supply container 91 that receives a rotational driving force from the supply device 9 for rotating the cylindrical portion 92*k* including the conveyance protrusion 92*c* will be described below.

Figure 9A:
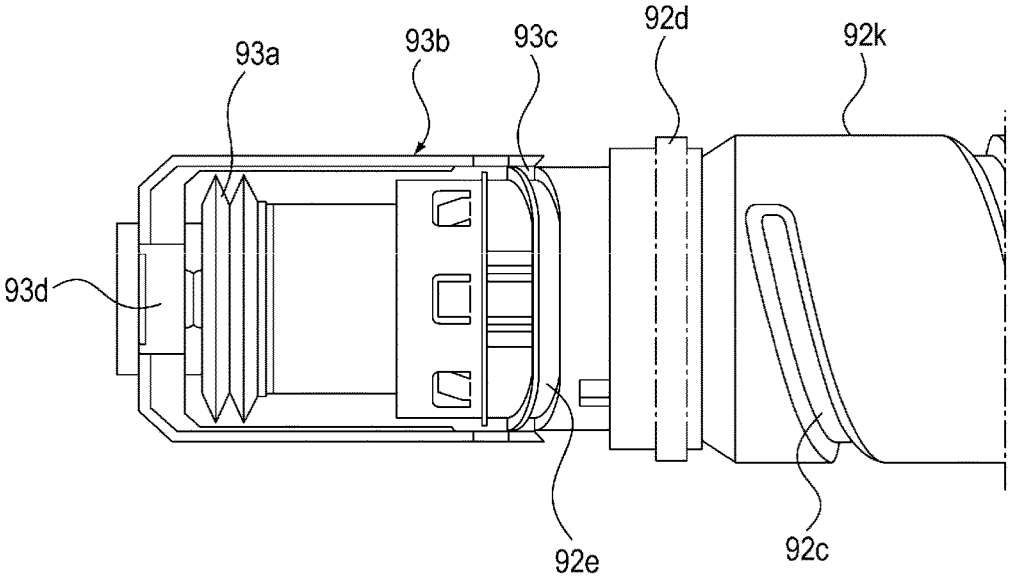
FIGS. 9A and 9B are diagrams illustrating a part of the developer supply container according to the embodiment of the invention.

As illustrated in FIG. 9A, the developer supply container 91 is provided with a gear portion 92*d* serving as a driving receiving mechanism (a driving receiving portion, a driving force receiving portion) that can engage with (be connected to) the driving gear 300 (serving as a driving mechanism) of the supply device 9. The gear portion 92*d* is configured to rotate along with the cylindrical portion 92*k*.

Figure 9B:
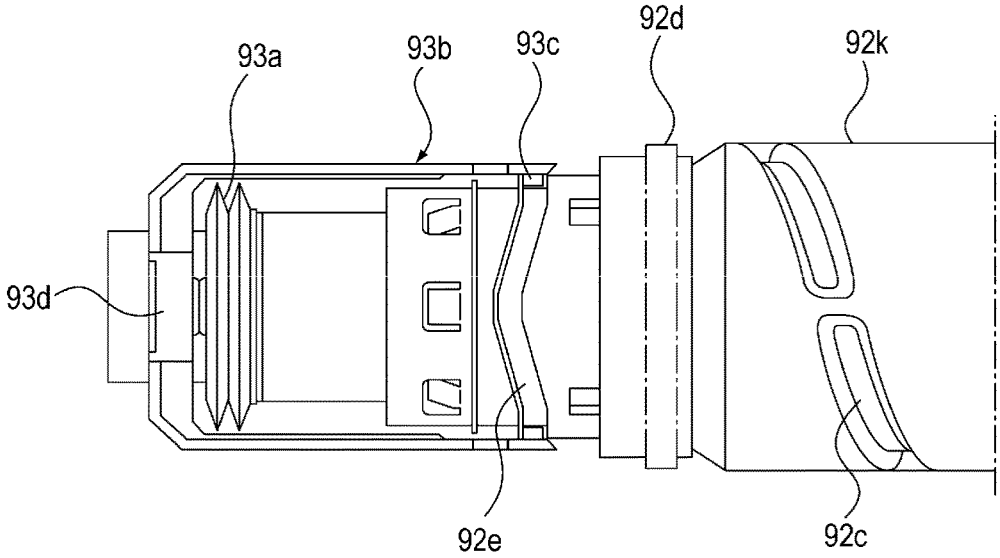

Accordingly, the rotational driving force input from the driving gear 300 to the gear portion 92*d* is transmitted to the pump portion 93*a* via a reciprocating member 93*b* illustrated in FIGS. 9A and 9B. Specifically, it is a driving converting mechanism to be described later. The bellows-shaped pump portion 93*a* in this example is formed of a resin material having characteristics strong to torsion in the rotating direction within a range in which its stretching and shrinking operation is not hindered.

(Driving Converting Mechanism)

A driving converting mechanism (a driving converting portion) of the developer supply container 91 will be described below. In this example, a cam mechanism is used as an example of the driving converting mechanism.

The developer supply container 91 is provided with a cam mechanism serving as a driving converting mechanism (a driving converting portion) that converts the rotational driving force for rotating the cylindrical portion 92*k*, which is received by the gear portion 92*d*, into a force in a direction in which the pump portion 93*a* reciprocates.

That is, in this example, by converting the rotational driving force received by the gear portion 92*d* into a reciprocating driving force on the developer supply container 91 side, a driving force for rotating the cylindrical portion 92*k* and a driving force for causing the pump portion 93*a* to reciprocate are received by a single driving receiving portion (the gear portion 92*d*).

Accordingly, in comparison with a case in which two driving receiving portions are separately disposed in the developer supply container 91, it is possible to simplify the configuration of a driving input mechanism of the developer supply container 91. Since the driving force is received from a single driving gear of the supply device 9, it is possible to contribute to simplification of the driving mechanism of the supply device 9.

(Regulating Portion)

Figure 10A:
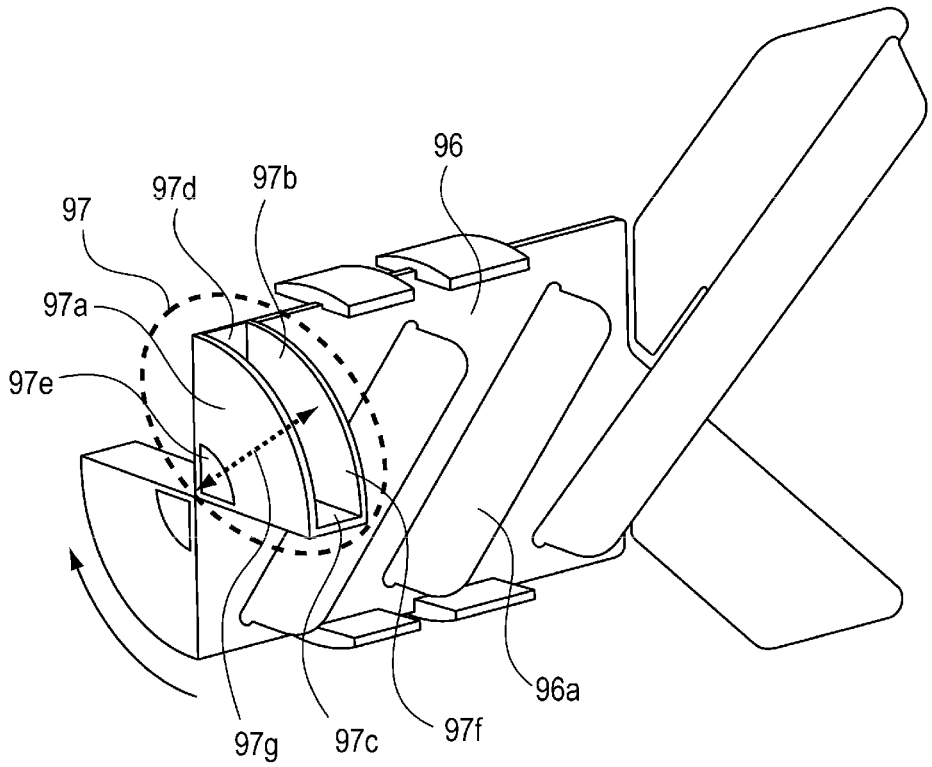
FIGS. 10A and 10B are a perspective view and a cross-sectional view of a whole conveyance member of the developer supply container according to the embodiment of the invention.
Figure 10B:
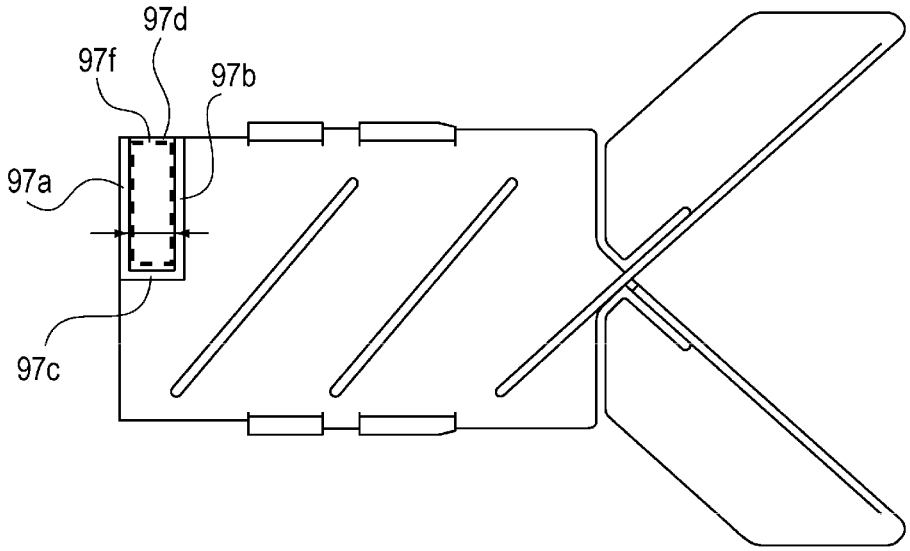

The regulating portion 97 will be described below with reference to FIG. 7, FIGS. 10A and 10B, and FIGS. 11A to 11D. FIG. 10A is a perspective view of the entire conveyance member 96 and FIG. 10B is a side view of the conveyance member 96. FIGS. 11A to 11D are cross-sectional views illustrating a state in the container in the supply operation when viewed from the pump portion 93*a* side in FIG. 7. As illustrated in FIG. 7, the regulating portion 97 in this configuration is disposed integrally with an end of the conveyance member 96 on the pump portion 93*a* side. Accordingly, the regulating portion 97 is also configured to rotate with the rotating operation of the conveyance member 96 rotating along with the cylindrical portion 92*k*.

As illustrated in FIGS. 10A and 10B, the regulating portion 97 includes two thrust suppression walls 97*a* and 97*b* that are disposed in parallel at positions separated by a width S in the rotation axis direction (arrow X in FIG. 8A) and two radial suppression walls 97*c* and 97*d* that are disposed in the rotating direction. A receiving portion opening 97*e* that can allow a space in the developer receiving portion 92 and a space in the regulating portion 97 to communicate with each other is formed in the vicinity of the rotation axis center of the thrust suppression wall 97*a* located on the pump portion 93*a* side. In this embodiment, the receiving portion opening 97*e* is disposed on a side surface of the regulating portion 97 on the pump portion side. A communicating portion opening 97*f* that can communicate with a communicating passage 94*d* is formed in a place surrounded by outer ends separated from the rotation axis center of the two thrust suppression walls 97*a* and 97*b* and the two radial suppression walls 97*c* and 97*d*. That is, the position in the rotation axis thrust direction of the communicating portion opening 97*f* is located at a position at which at least a part overlaps the communicating passage 94*d*. A ventilation passage 97*g* that can allow the receiving portion opening 97*e* and the communicating portion opening 97*f* to communicate with each other is formed in a space in the regulating portion 97 surrounded with the two thrust suppression walls 97*a* and 97*b* and the two radial suppression walls 97*c* and 97*d*. In this embodiment, the regulating portion 97 covers the communicating passage (the communicating portion) 94*d* in the rotation axis direction.

The operation of the regulating portion 97 in the developer supply step will be described below with reference to FIGS. 11A to 11D.

Figure 11A:
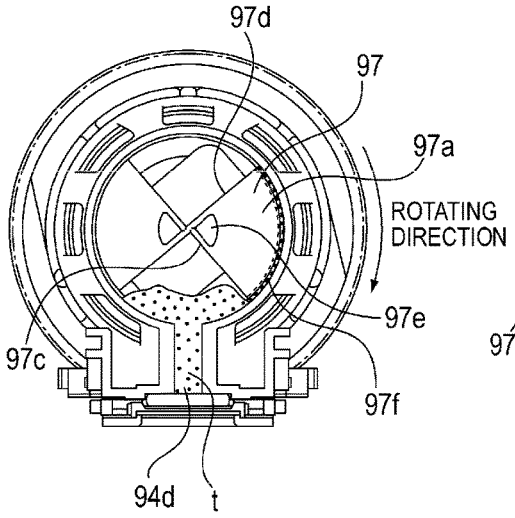
FIGS. 11A to 11D are cross-sectional views of a discharge portion when a pump portion of the developer supply container according to the embodiment of the invention operates.
Figure 11B:
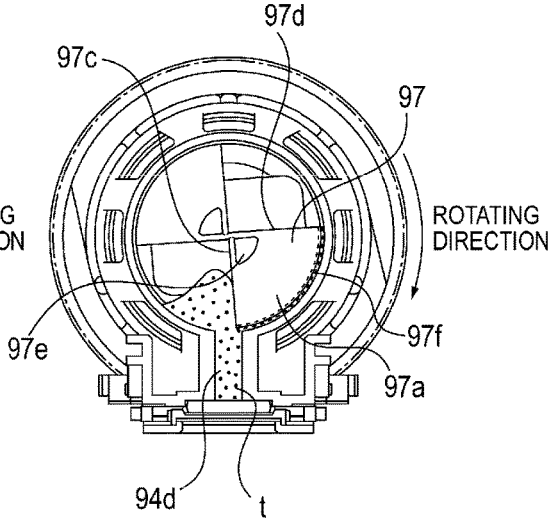
Figure 11C:
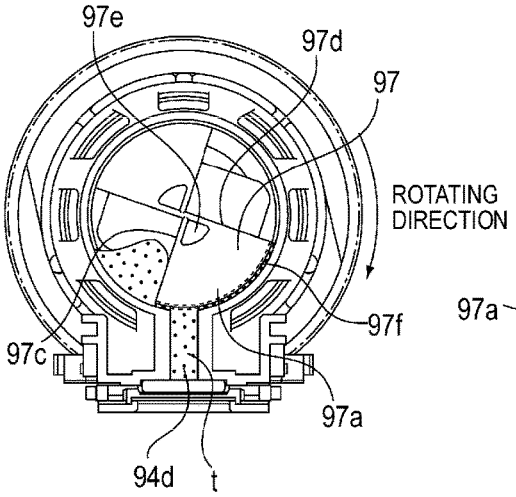
Figure 11D:
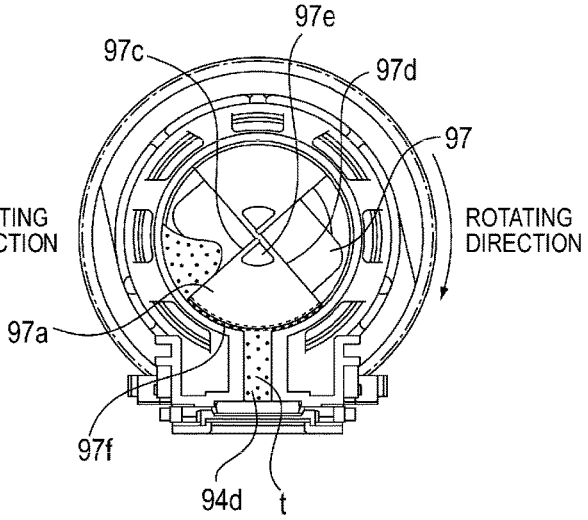

FIG. 11A is a cross-sectional view of the discharge portion in an operation stopping process of the pump portion according to a first embodiment. FIG. 11B is a cross-sectional view of the discharge portion when an intake operation is performed according to the first embodiment. FIG. 11C is a cross-sectional view of the discharge portion when an exhaust operation is performed according to the first embodiment. FIG. 11D is a cross-sectional view of the discharge portion after developer is discharged according to the first embodiment.

In FIG. 11A, the developer supply container 91 is in the operation stopping process in which the pump portion 93*a* stops with the rotation of the cylindrical portion 92*k*.

At this time, the regulating portion 97 rotates along with the rotation of the conveyance member 96 and the upper portion of the communicating passage 94*d* located in the bottom of the discharge portion 94*c* is not covered with the communicating portion opening 97*f* of the regulating portion 97. Since the pump portion 93*a* is in the operation stopping process and thus does not reciprocate, the pressure in the developer receiving portion 92 is not changed. In this embodiment, the conveyance member 96 has a function of a moving portion that causes the regulating portion 97 to move to the upper part (an entrance area) of the opening of the communicating passage 94*d* and to retract from the entrance area.

As a result, the regulating portion 97 does not act on the communicating passage 94*d* and developer t conveyed to the vicinity of the upper part of the communicating passage 94*d* by the conveyance member 96 flows in the communicating passage 94*d* and is stored therein (a developer inflow non-regulated state).

The conveyance member 96 rotates from the developer inflow non-regulated state to the state illustrated in FIG. 11B.

In FIG. 11B, the pump portion 93*a* is in the middle state from the most shrunk state to the most stretched state, that is, in the intake process.

At this time, the regulating portion 97 rotates with the rotation of the conveyance member 96 and is changed from a state in which the upper part of the communicating passage 94*d* is not covered with the communicating portion opening 97*f* of the regulating portion 97 to a state in which a part of the upper part of the communicating passage 94*d* is covered. Since the pump portion 93*a* is in the intake process, the pump portion 93*a* is stretched, the inside of the developer receiving portion 92 is depressurized, air outside the developer supply container 91 moves into the developer supply container 91 via the discharge port 94*a* due to a difference in pressure between the inside and the outside of the developer supply container 91.

As a result, developer t stored in the communicating passage 94*d* in the above-mentioned process includes the air taken from the discharge port 94*a*, decreases in bulk density, and is fluidized.

In the upper part of the communicating passage 94*d*, the radial suppression wall 97*c* downstream in the rotating direction of the regulating portion 97 pushes out the developer t in the upper part of the communicating passage 94*d* by covering the upper part of the communicating passage 94*d* with the communicating portion opening 97*f* of the regulating portion 97 with the rotation of the regulating portion 97. A part of the upper part of the communicating passage 94*d* is covered with the communicating portion opening 97*f* of the regulating portion 97. As a result, flowing of the developer t in the vicinity of the upper part of the communicating passage 94*d* into the communicating passage 94*d* is regulated by the thrust suppression walls 97*a* and 97*b* and the radial suppression walls 97*c* and 97*d* of the regulating portion 97 (a developer inflow regulated state).

The conveyance member 96 rotates from the developer inflow regulated state to the state illustrated in FIG. 11C.

In FIG. 11C, the pump portion 93*a* is in the middle from the most stretched state to the most shrunk state, that is, in the exhaust process.

At this time, the regulating portion 97 rotates with the rotation of the conveyance member 96 and at least a part of the communicating portion opening 97*f* of the regulating portion 97 covers the upper part of the communicating passage 94*d*, normally. Since the pump portion 93*a* is in the exhaust process, the pump portion 93*a* is shrunk, the pressure in the developer supply container 91 becomes higher than the atmospheric pressure. Accordingly, air inside the developer supply container 91 moves out of the developer supply container 91 via the discharge port 94*a* due to a difference in pressure between the inside and the outside of the developer supply container 91.

As a result, developer t fluidized in the communicating passage 94*d* in the above-mentioned intake process is discharged to the developing device 4 via the discharge port 94*a*.

In the exhaust process, in the upper part of the communicating passage 94*d*, flowing of the developer t in the vicinity of the upper part of the communicating passage 94*d* into the communicating passage 94*d* is regulated (the developer inflow regulated state) subsequently to the above-mentioned intake process.

In the exhaust process, the developer t in the communicating passage 94*d* that can communicate with the ventilation passage 97*g* is discharged to the developing device 4 with an air flow by the air passing through the ventilation passage 97*g* in the regulating portion 97. As described above, in the exhaust process, since the communicating passage 94*d* is in the developer inflow regulated state in which flowing of the developer t is always regulated by the regulating portion 97, an almost constant amount of developer is stored in the communicating passage 94*d*.

Since the spaces inside and outside the developer supply container 91 communicate with each other at the time point at which the developer t in the communicating passage 94*d* is discharged (FIG. 11D) and then only air is discharged, the pressure inside the developer supply container 91 in the exhaust process finally becomes equal to the pressure outside the developer supply container 91. That is, after the developer t in the communicating passage 94*d* is discharged, only air is discharged due to a difference in pressure between the inside and the outside of the developer supply container 91, and the developer t is not discharged. Accordingly, in the exhaust process, since only a constant amount of developer t stored in the communicating passage 94*d* is discharged, it is possible to discharge the developer t to the developing device 4 with very high supply accuracy.

In the exhaust process, it is desirable that the communicating portion opening 97*f* of the regulating portion 97 completely cover the upper part of the communicating passage 94*d* without any gap (a regulating portion gap). Accordingly, in the exhaust process, the developer t in the vicinity of the upper part of the communicating passage 94*d* does not flow into the communicating passage 94*d* and it is thus possible to achieve more stable supply accuracy.

According to this configuration, the intake process and the exhaust process are repeated two times whenever the developer supply container 91 rotates by one turn. Accordingly, the developer t can be supplied two times whenever the developer supply container 91 rotates by one turn. A supplied quantity (a unit supplied quantity Tb) per half turn of the developer supply container of the image forming apparatus according to this embodiment is set to 0.30 g. The rotating speed of the developer supply container 91 in this embodiment is set to 1 rps.

However, in the supply configuration of this embodiment, the supplied toner quantity supplied from the developer supply container depends on fluidity of the toner. The regulating portion 97 normally regulates flowing of the developer t into the communicating passage 94*d* and a constant amount of developer is stored in the communicating passage 94*d* in the exhaust process. The volume of the communicating passage 94*d* is constant and the amount of toner in the communicating passage 94*d* varies depending on the bulk density of the toner. Accordingly, when the fluidity of toner varies, the supplied toner quantity also varies as a result.

Figure 12:
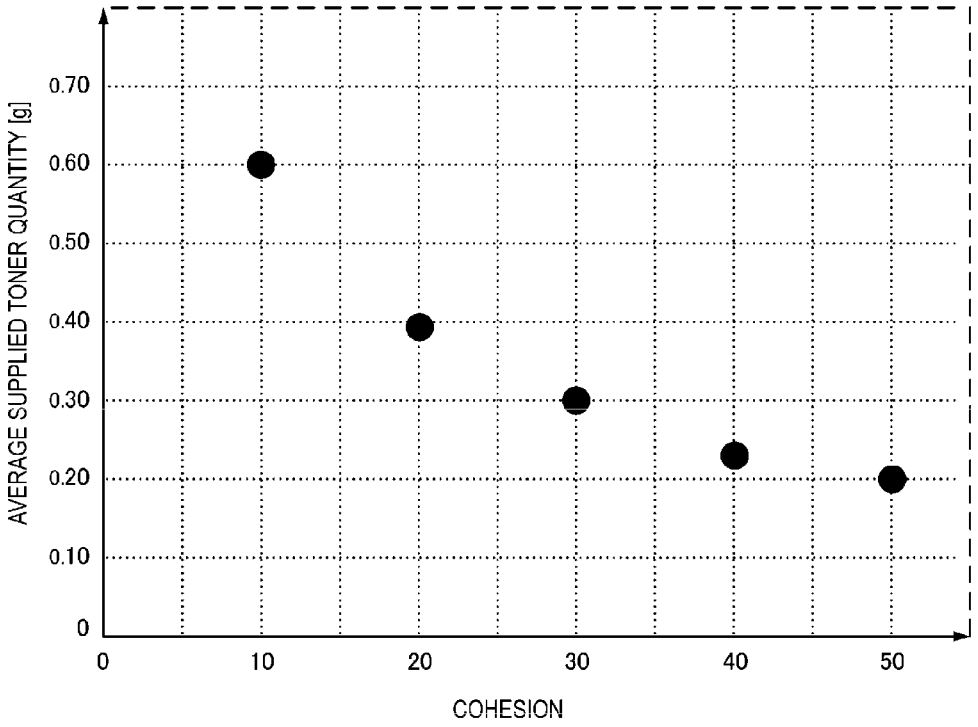
FIG. 12 is a graph illustrating a relationship between a toner cohesion and a supplied toner quantity.

FIG. 12 is a diagram illustrating a relationship between cohesion which is an index indicating fluidity of toner and an average supplied toner quantity which is supplied every turn by the developer supply container 91.

As illustrated in FIG. 12, it can be seen that the supplied quantity per turn of the developer supply container 91 increases as the cohesion of toner decreases (as the fluidity increases) and the supplied quantity per turn of the developer supply container 91 decreases as the cohesion of toner increases (as the fluidity decreases). The cohesion of toner varies depending on a colorant or a production lot thereof. Accordingly, even when the unit supplied quantity is set based on a certain production lot, but the developer supply container is replaced and toner of a different production lot is supplied, a supplied quantity error is generated.

In this embodiment, the cohesion of toner varies from 20 to 45 due to a production variation of toner. Accordingly, by replacement of the developer supply container, the supplied toner quantity per turn of the developer supply container varies from 0.21 g to 0.39 g.

Figure 13A:
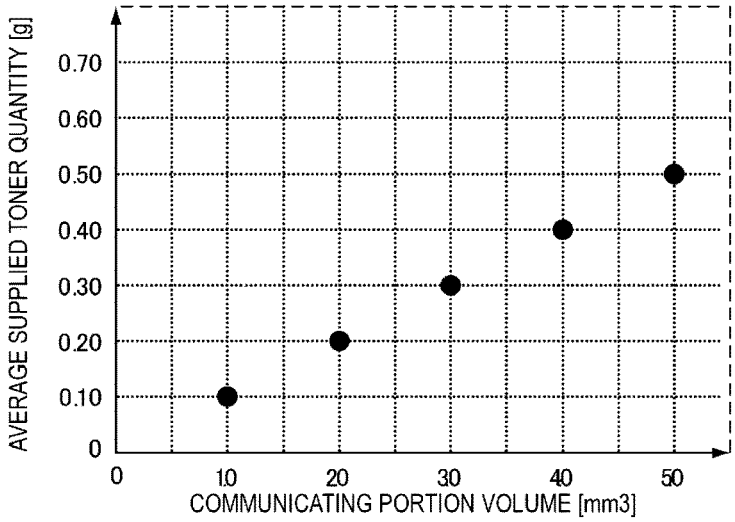
FIGS. 13A to 13C are graphs illustrating relationships between component dimensions and a supplied toner quantity.
Figure 13B:
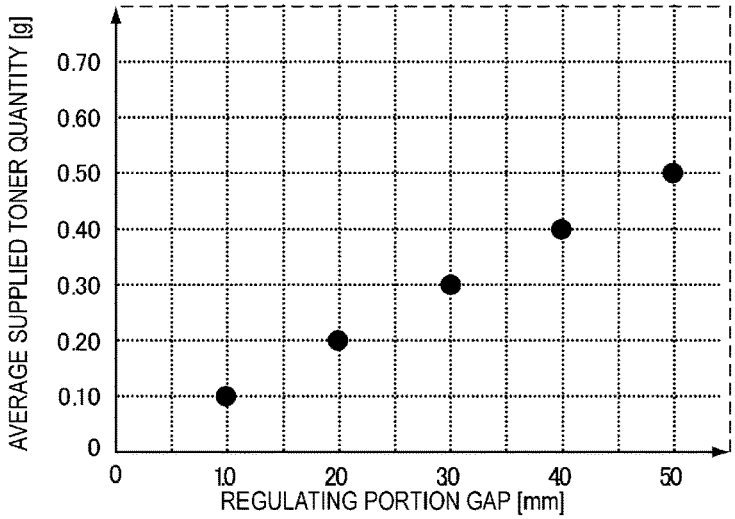
Figure 13C:
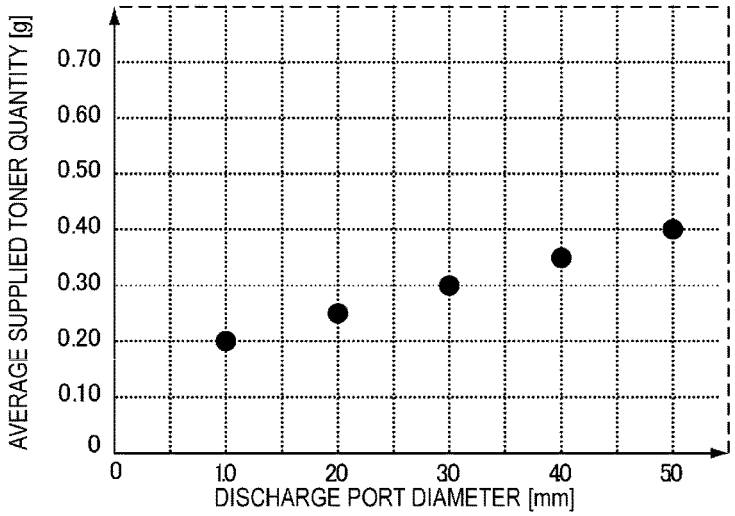

The supplied toner quantity varies depending on a production variation of components of the developer supply container 91. FIGS. 13A to 13C illustrate the supplied toner quantity per turn of the developer supply container and sensitivities of members in the developer supply container. FIG. 13A illustrates a relationship between the supplied toner quantity per turn of the developer supply container and the volume of the communicating passage 94*d*. FIG. 13B illustrates a relationship between the supplied toner quantity per turn of the developer supply container and a regulating portion gap (a gap between the communicating portion opening 97*f* of the regulating portion 97 and the upper part of the communicating passage 94*d*). FIG. 13C illustrates a relationship between the supplied toner quantity per turn of the developer supply container and the diameter of the discharge port 94*a*.

As illustrated in FIG. 13A, it can be seen that the supplied toner quantity increases as the volume of the communicating passage 94*d* increases and the supplied toner quantity decreases as the volume of the communicating passage 94*d* decreases. In this configuration, since a constant amount of developer t stored in the communicating passage 94*d* is discharged by the regulating portion 97, the volume of the communicating passage 94*d* and the supplied toner quantity have a proportional relationship.

As illustrated in FIG. 13B, it can be seen that the supplied toner quantity increases as the regulating portion gap increases and the supplied toner quantity decreases as the regulating portion gap decreases. In this configuration, since a constant amount of developer t stored in the communicating passage 94*d* is discharged by the regulating portion 97, the supplied toner quantity also increases with an increase in the amount of toner which cannot be regulated by the regulating portion 97.

As illustrated in FIG. 13C, it can be seen that the supplied toner quantity increases as the diameter of the discharge port 94*a* increases and the supplied toner quantity decreases as the diameter of the discharge port 94*a* decreases. In this configuration, when the regulating portion 97 pushes out the developer t in the upper part of the communicating passage 94*d*, the developer t stored in the communicating passage 94*d* is forced to be discharged from the discharge port 94*a*. This is disclosed in Japanese Patent Laid-Open No. 2014-186138. That is, when the diameter ϕ of the discharge port is equal to or greater than 4 mm (an opening area of 12.6 ($mm^2$)), the toner is discharged by a gravitational action and thus the supplied toner quantity increases rapidly. On the other hand, when the diameter ϕ of the discharge port is equal to or less than 4 mm (an opening area of 12.6 ($mm^2$)), discharge resistance increases and the supplied toner quantity decreases with a decrease in the diameter of the discharge port.

As described above, the supplied toner quantity varies depending on a production variation of the components of the developer supply container 91.

<Toner Supply Control>

Toner supply control which is a fundamental feature of the invention will be described below.

In this embodiment, supply control using the same video count supply scheme as in the related art and an inductance supply scheme in parallel is performed.

Figure 14:
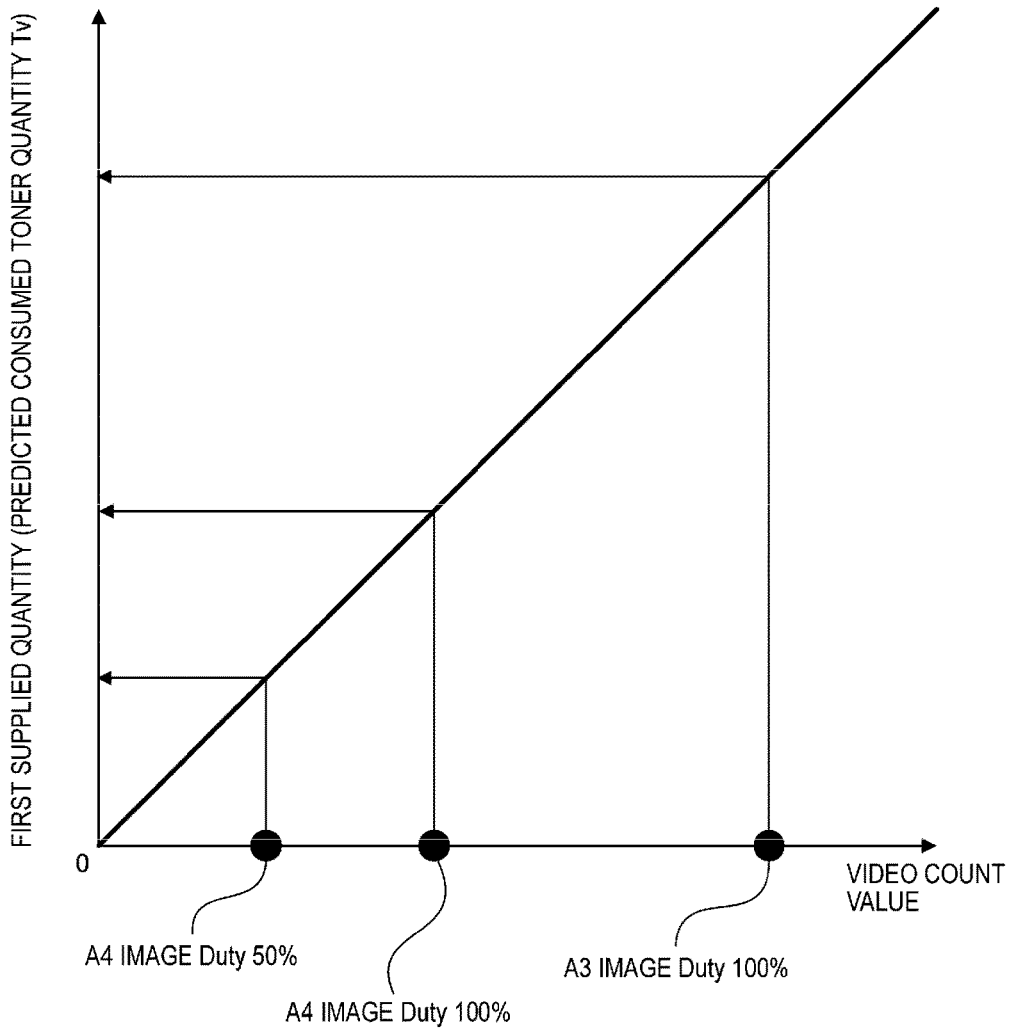
FIG. 14 is a graph illustrating a relationship between a video count value and a first supplied quantity.

FIG. 14 illustrates a relationship between a predicted consumed toner quantity Tv and a video count value in the video count supply scheme. The predicted consumed toner quantity Tv exhibits a relationship proportional to the video count value. In the video count supply scheme, the supplied quantity is determined depending on the consumed toner quantity predicted from an image ratio (a video count value). In this embodiment, the predicted consumed toner quantity Tv is set as a first supplied quantity.

However, in the video count supply scheme, when there is a difference between the consumed toner quantity predicted from the image ratio and the consumed toner quantity which is actually consumed, the toner density in the developing device increases or decreases. Even when there is a difference between a preset unit supplied quantity and an actual supplied quantity in the image forming apparatus, the toner density in the developing device increases or decreases.

Figure 15:
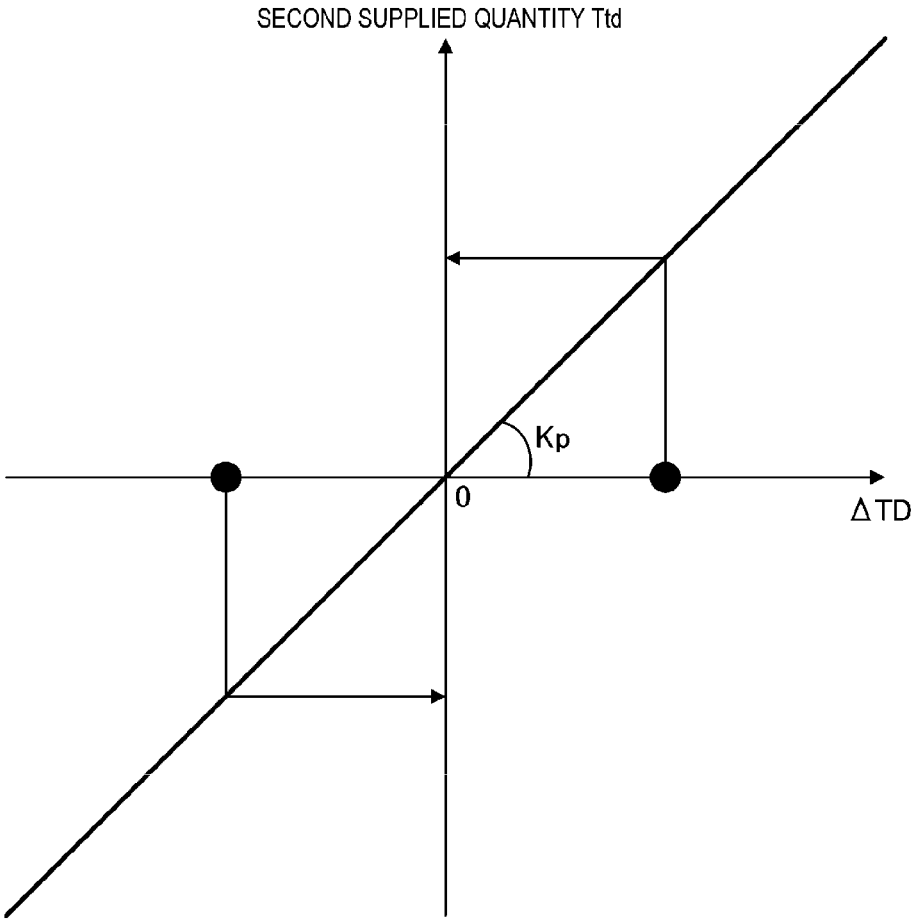
FIG. 15 is a graph illustrating a relationship between a toner density deviation and a second supplied quantity.

FIG. 15 illustrates a relationship of the supplied toner quantity with respect to a toner density target value and a toner density deviation. When a difference between a target toner density and a detected toner density is defined as ΔTD and a conversion factor into the supplied toner quantity, that is, a feedback ratio of the toner density (FB ratio), is defined as Kp, a supplied toner quantity Ttd (a second supplied quantity) in the inductance supply scheme can be expressed by Expression (1).

$$Ttd = Kp \times \Delta TD \quad (1)$$

When the detected toner density is lower than a target value (a target toner density), a necessary toner quantity is supplied. On the other hand, when the detected toner density is higher than the target value, toner is considered to be excess and the supplied quantity is decreased.

Accordingly, the supplied toner quantity T which is actually supplied in this embodiment is expressed by Expression (2). The supplied toner quantity T is calculated every image formation.

$$T = Tv + Ttd \quad (2)$$

The developer supply container according to this embodiment is equipped with an information storage portion (a nonvolatile memory) in which information specific to colors is stored. An IC chip, a barcode, or the like can be used as the information storage portion, and the information be automatically read by an information reading portion (a communication portion 1501 illustrated in FIG. 16) on the apparatus body side can be used. A memory tag 90 (see FIG. 16) which is the information storage portion in this embodiment is installed on the front surface of the flange portion 94, and reading and writing of data can be performed thereon by the CPU of the image forming apparatus. The image forming apparatus is provided with the information reading portion (the communication portion 1501 illustrated in FIG. 16) that reads information of the memory tag disposed in the developer supply container. The information reading portion is configured to communicate with the memory tag 90 when the developer supply container is attached to the image forming apparatus (the attachment portion 910).

Information specific to each developer supply container is stored in the memory tag. Examples of the specific information include a production date and a production lot of toner, powder characteristics of toner, and component accuracy for each production lot of the developer supply containers. In the first embodiment, at least data of toner cohesion is included as the information specific to the developer supply container. When a new developer supply container is set in the image forming apparatus, toner cohesion is read from the memory tag 90 of the developer supply container by the information reading portion (the communication portion 1501 in FIG. 16) disposed in the image forming apparatus. A unit supplied quantity stored in a RAM 601 (see FIG. 16) is corrected based on the read toner cohesion.

Specifically, toner cohesion for each lot is measured in advance in the stage of producing toner, and data of cohesion of toner received at the time of filling the developer supply container with toner is stored in the memory tag. Accordingly, the cohesion of toner is measured for each production lot of toner and the same cohesion is stored in the memory tags of the developer supply containers filled with toner of the same production lot.

More specifically, when the read cohesion is 20, the unit supplied quantity stored in the RAM is changed (corrected) from 0.30 g which is an initial value to 0.39 g based on the relationship between the cohesion and the average supplied toner quantity (see FIG. 12) stored in the ROM in advance. Accordingly, an error between the actual supplied quantity and the unit supplied quantity decreases.

Figure 16:
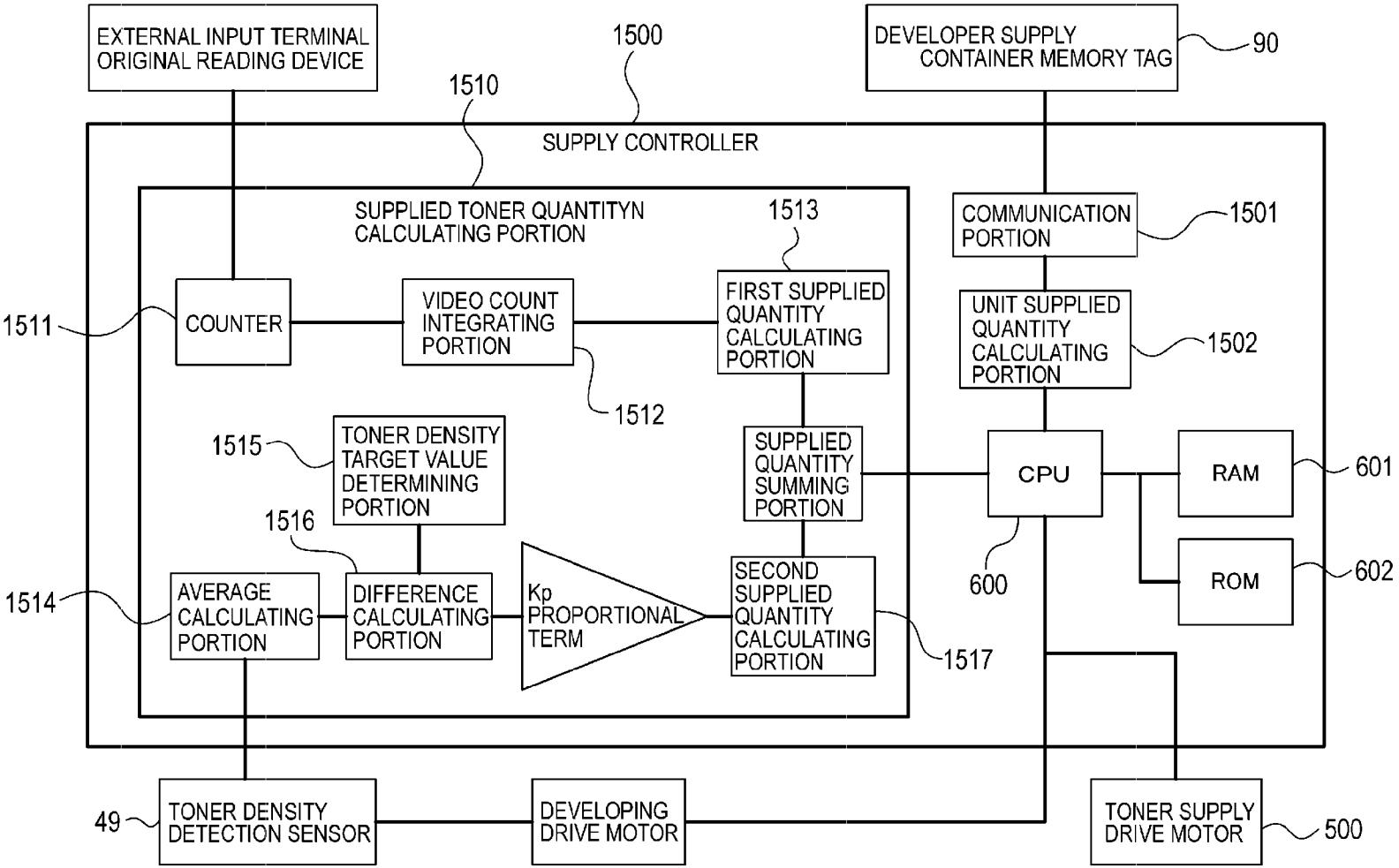
FIG. 16 is a block diagram illustrating toner supply control according to a first embodiment of the invention.

FIG. 16 is a block diagram illustrating a supply controller 1500 according to this embodiment. A video count integrating portion 1512 counts the video count value of a density signal of an image information signal from an external input terminal or an original reader using a counter 1511. A first supplied quantity calculating portion 1513 calculates a predicted consumed toner quantity based on the video count value stored in the ROM 602 in advance and sets the calculated predicted consumed toner quantity as a first supplied quantity. A difference calculating portion 1516 calculates a difference ΔTD between a toner density determined by a toner density target value determining portion 1515 and a toner density detected by a toner density sensor 49 via an average calculating portion 1514. A second supplied quantity calculating portion 1517 calculates a second supplied quantity based on the difference ΔTD between the target toner density calculated by the difference calculating portion 1516 and the detected toner density and a proportional term (a conversion factor into the supplied toner quantity) Kp. A supplied quantity summing portion sums the first supplied quantity and the second supplied quantity. A supplied toner quantity calculating portion 1510 calculates the supplied toner quantity as described above. On the other hand, the memory tag 90 disposed in the developer supply container communicates with the communication portion (the information reading portion) 1501 disposed in the image forming apparatus and information specific to the developer supply container is read from the memory tag 90. A unit supplied quantity calculating portion (a correction portion) 1502 corrects the unit supplied quantity based on the read specific information. The CPU (the controller) 600 drives a toner supply driving motor 500 and a developing driving motor which are discharge mechanisms to perform a developer supply operation based on a comparison result of the supplied quantity calculated by the supplied toner quantity calculating portion 1510 and the unit supplied quantity corrected by the unit supplied quantity calculating portion 1502. In this way, the CPU (the controller) 600 controls the operation of the discharge mechanism to achieve the set amount of developer discharged using the information read by the information reading portion.

Figure 17:
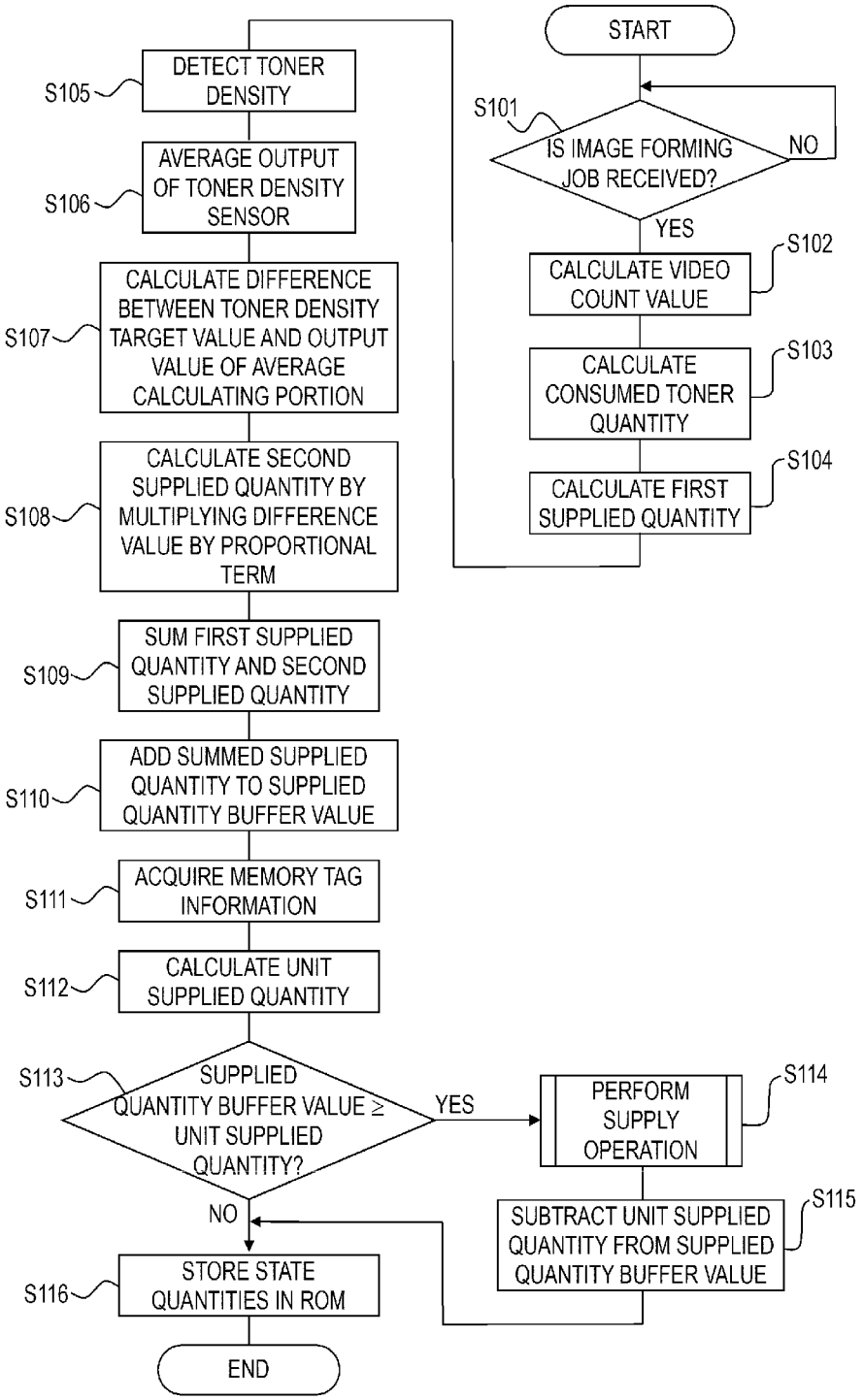
FIG. 17 is a flowchart illustrating the toner supply control according to the first embodiment of the invention.

In this embodiment, developer corresponding to a consumed developer quantity is supplied using the unit supplied quantity corrected by the unit supplied quantity calculating portion 1502. This operation will be specifically described below with reference to FIG. 17. FIG. 17 is a flowchart illustrating the operation of the CPU 600.

When the image forming apparatus is powered on, a controller is in a standby state. When an image formation request is input from the outside (S101), the image formation is started, a rotation instruction is issued to the developing driving motor by the CPU 600, and the developing screw 43 and the agitating screw 44 start rotating.

A video count value input from the counter 1511 based on an image information signal is integrated by the video count integrating portion 1512 and is input to a supply controller 1500 every image formation (S102). The input video count integrated value is determined as the first supplied quantity Tv by the first supplied quantity calculating portion 1513. That is, the video count integrated value is determined as the first supplied quantity Tv corresponding to the consumed toner quantity (S103) predicted from the video count value with reference to a conversion table (FIG. 14) indicating a correlation between the video count value and the consumed toner quantity Tv (S104).

Subsequently, an output of the toner density sensor 49 is detected (S105). The output of the toner density sensor 49 is detected with a pulsation in a screw rotation cycle due to a local variation in bulk density of developer of the sensor portion with the rotation of the agitating screw 44. Accordingly, the average calculating portion 1514 illustrated in FIG. 16 averages and smooths agitating screw rotation cycles (S106). The timing at which the averaging process is performed is after the agitating screw rotates by at least one turn from the rotation start of the developer agitating screw, whereby a stable output is acquired.

The difference calculating portion 1516 calculates a difference (toner density target value−toner density) ΔTD between the toner density averaged by the average calculating portion 1514 and the target value set by the toner density target value determining portion 1515 (S107).

Then, the second supplied quantity Ttd is determined by multiplying the output (the difference ΔTD) of the difference calculating portion 1516 by the gain Kp (S108). In this embodiment, the proportional gain Kp is set to 0.1.

The first supplied quantity Tv and the second quantity Ttd are summed by the supplied quantity summing portion (S109), and the summed value is added to a supplied quantity buffer value (S110). The supplied quantity buffer value is a supplied toner quantity which is compared with the unit supplied quantity serving as a reference to determine whether to perform the supply operation and is stored in the RAM 601. The unit supplied quantity is a supplied developer quantity per unit time, is set in advance, and is stored in the RAM 601. Here, a supplied quantity per half turn of the developer supply container (a unit supplied quantity Tb) is exemplified as the unit supplied quantity, and 0.30 g is exemplified as the initial set value. The unit supplied quantity is not limited thereto, but can be appropriately set if necessary.

The communication portion 1501 communicates with the memory tag 90 disposed in the developer supply container and acquires memory tag information which is information specific to the developer supply container (S111). The unit supplied quantity calculating portion 1502 corrects the unit supplied quantity based on toner cohesion information in the acquired memory tag information and the relationship between the toner cohesion and the unit supplied quantity which is stored in the ROM 602 in advance (S112).

Thereafter, the supplied quantity buffer value calculated in S109 is compared with the unit supplied quantity corrected in S112 (S113). When the supplied quantity buffer value is equal to or greater than the unit supplied quantity, a supply driving command is issued to the toner supply driving motor 500 (S114) and the toner supply operation is performed. Thereafter, the unit supplied quantity is subtracted from the supplied quantity buffer value (S115). After the supply operation ends, various state quantities such as the supplied quantity buffer value subjected to subtraction in S115 are stored in the ROM (S116) and the operation ends. On the other hand, when the supplied quantity buffer value does not reach a value equal to or greater than the unit supplied quantity in S113, that is, when the supplied quantity buffer value is less than the unit supplied quantity, the toner supply operation is not performed and this supply is passed. When the supply operation is not performed, various state quantities such as the supplied quantity buffer value subjected to addition in S110 are stored in the ROM (S116) and the operation ends. When image formation is continuously performed, a series of processes of S102 to S116 are performed. When an image formation request is not issued, the series of process ends.

The supplied quantity buffer value stored in the ROM in S116 is used as a supplied quantity buffer value to which the summed supplied quantity of the first supplied quantity and the second supplied quantity is added in a next image formation job.

The above-mentioned operation is normally performed while the image forming apparatus forms an image, thereby suitably maintaining the toner density in the developing device 4.

Advantages of the toner supply control according to the embodiment of the invention will be described below with reference to FIG. 18.

As a comparative example of the embodiment, a supply control method of not reflecting toner cohesion information stored in the memory tag in the unit supplied quantity will be exemplified. In the supply control flow according to the comparative example, the operations of S111 to S112 illustrated in FIG. 17 are not performed and the other operations of the supply control flow are the same as in the first embodiment. In the embodiment and the comparative example, the set value of the unit supplied quantity Tb is 0.30 g, the toner cohesion in the developer supply container is 20 depending on a production variation of toner, and the actual average supplied toner quantity per one turn is 0.42 g due to component tolerance of the developer supply container.

In the comparative example, since information specific to the developer supply container which is stored in the memory tag is not reflected in the unit supplied quantity, there is a supply error (0.12 g herein) between the actual supplied quantity (0.42 g herein) and the unit supplied quantity (0.30 g herein). As a result, a large stationary error is generated between the toner density target value and the actual toner density in the supply control according to the comparative example and there is a variation in toner density of about 1%.

On the other hand, in the first embodiment, toner cohesion information is read from the memory tag and the set value of the unit supplied quantity is corrected to 0.39 g based on the read cohesion information. That is, when the read cohesion is 20, the unit supplied quantity stored in the RAM is changed (corrected) from 0.30 g as an initial value to 0.39 g based on the relationship (see FIG. 12) between the cohesion and the average supplied toner quantity which is stored in the ROM in advance. As a result, the supply error (0.03 g) between the actual supplied quantity and the corrected unit supplied quantity decreases, the stationary error between the toner density target value and the actual toner density is about 0.25%, and it is thus possible to decrease the variation in toner density.

In this way, according to the embodiment, since the unit supplied quantity which is used to supply developer is corrected based on the information specific to the developer supply container, it is possible to decrease the variation in supplied developer quantity due to an actual variation specific to the developer supply container and to decrease a variation in density of developer.

Second Embodiment

An image forming apparatus according to a second embodiment will be described below. The schematic configuration of the image forming apparatus according to the second embodiment is the same as that of the first embodiment and thus will not be repeated. Details of the toner supply control in the second embodiment are the same as those in the first embodiment, except that information on component dimension of the developer supply container stored in the memory tag is read, and thus will not be repeated.

In the first embodiment, the toner cohesion is used as the information specific to the developer supply container stored in the memory tag. On the other hand, in the second embodiment, the unit supplied quantity is corrected using information on component dimensions of the developer supply container in the information stored in the memory tag which is acquired in the control step (S111) in FIG. 17.

Specifically, in the step of manufacturing the developer supply container, component dimensions of molded products formed in cavities of a mold are measured in advance for each lot and the component dimension data is stored in the memory tag. Accordingly, the component dimensions of the molded products formed in the cavities are measured for each production lot of the developer supply containers, and the same component dimensions are stored in the memory tags of the developer supply containers using the components formed in the same cavities in the same production lot.

In this embodiment, component dimensions of the components having a large influence on supply accuracy are stored in the memory tag. More specifically, the volume of the communicating passage 94*d*, the distance between the rotation axis center of the regulating portion 97 and the radial suppression wall 97*c* which determines the regulating portion gap, the inner diameter of the flange portion 94 corresponding to the upper part of the communicating passage 94*d*, and the diameter of the discharge port 94*a* are stored in the memory tag.

The unit supplied quantity stored in the RAM is corrected based on the relationships between (1) the volume of the communicating passage 94*d*, (2) the regulating portion gap, (3) the diameter of the discharge port 94*a* and the average supplied toner quantity (see FIGS. 13A to 13C), stored in the ROM in advance. In this embodiment, the unit supplied quantity is corrected based on the average supplied toner quantity predicted in (1) to (3).

With respect to a design center volume 300 $mm^3$ of the communicating passage 94*d*, a design center distance 1.5 mm of the regulating portion gap, and a diameter 3 mm of the discharge port 94*a*, component dimensions of the developer supply container in this embodiment are as follows. That is, in the component dimensions of the developer supply container in this embodiment, the volume of the communicating passage 94*d* is 330 $mm^3$, the regulating portion gap is 1.6 mm, and the diameter of the discharge port 94*a* is 2.8 mm. The average supplied toner quantities are calculated to be 0.33 g, 0.32 g, and 0.28 g based on the component dimensions from FIGS. 13A to 13C. The sum of the differences (0.03 g+0.02 g−0.02 g=0.03 g) between the average supplied toner quantities and the initial unit supplied quantity 0.30 g is calculated and the sum of the differences is added to the initial value 0.30 g which is the unit supplied quantity stored in the RAM. Accordingly, in this embodiment, the unit supplied quantity is corrected and changed from 0.30 g to 0.33 g. As a result, an error between the actual supplied quantity and the unit supplied quantity decreases. The correction method is not limited to the above-mentioned method, but weighting may be performed depending on factors.

Figure 18:
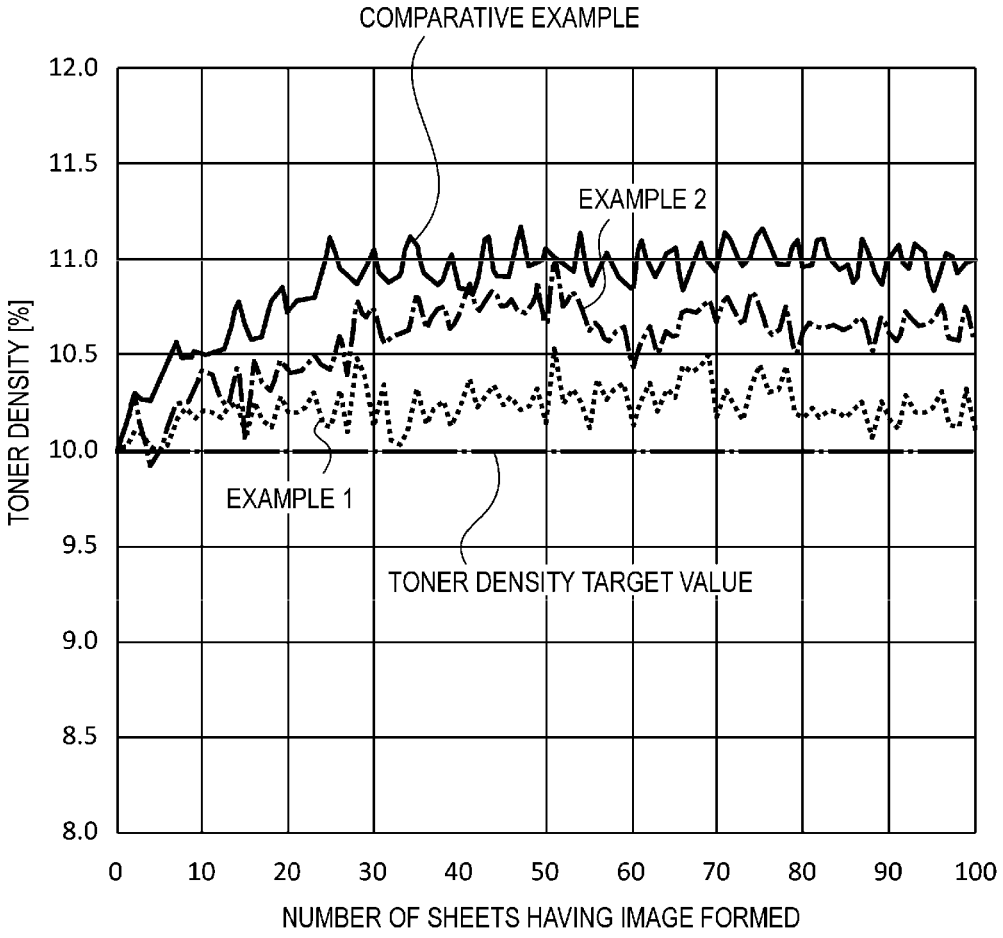
FIG. 18 is a diagram illustrating an advantageous effect of first and second embodiments of the invention.

FIG. 18 illustrates advantages of the toner supply control according to the second embodiment. Similarly to the first embodiment, the cohesion of toner in the developer supply container is 20 due to a production variation of toner and the actual average supplied toner quantity per one turn is 0.42 g/turn due to component tolerance of the developer supply container.

In the second embodiment, component dimension information is read as the information specific to the developer supply container stored in the memory tag and the set value of the unit supplied quantity is corrected to 0.33 g. As a result, the supply error (0.09 g) between the actual supplied quantity and the corrected unit supplied quantity decreases and the stationary error between the toner density target value and the actual toner density is about 0.75%. Accordingly, in comparison with the above-mentioned comparative example, it is thus possible to decrease the variation in toner density.

In this way, according to this embodiment, since the unit supplied quantity which is used to supply developer is corrected based on the information specific to the developer supply container, it is possible to decrease the variation in supplied developer quantity due to an actual variation specific to the developer supply container and to decrease a variation in density of developer.

Third Embodiment

An image forming apparatus according to a third embodiment will be described below. In the third embodiment, the unit supplied quantity corrected in the first and second embodiments is used for residual toner quantity prediction control of the developer supply container.

Figure 19:
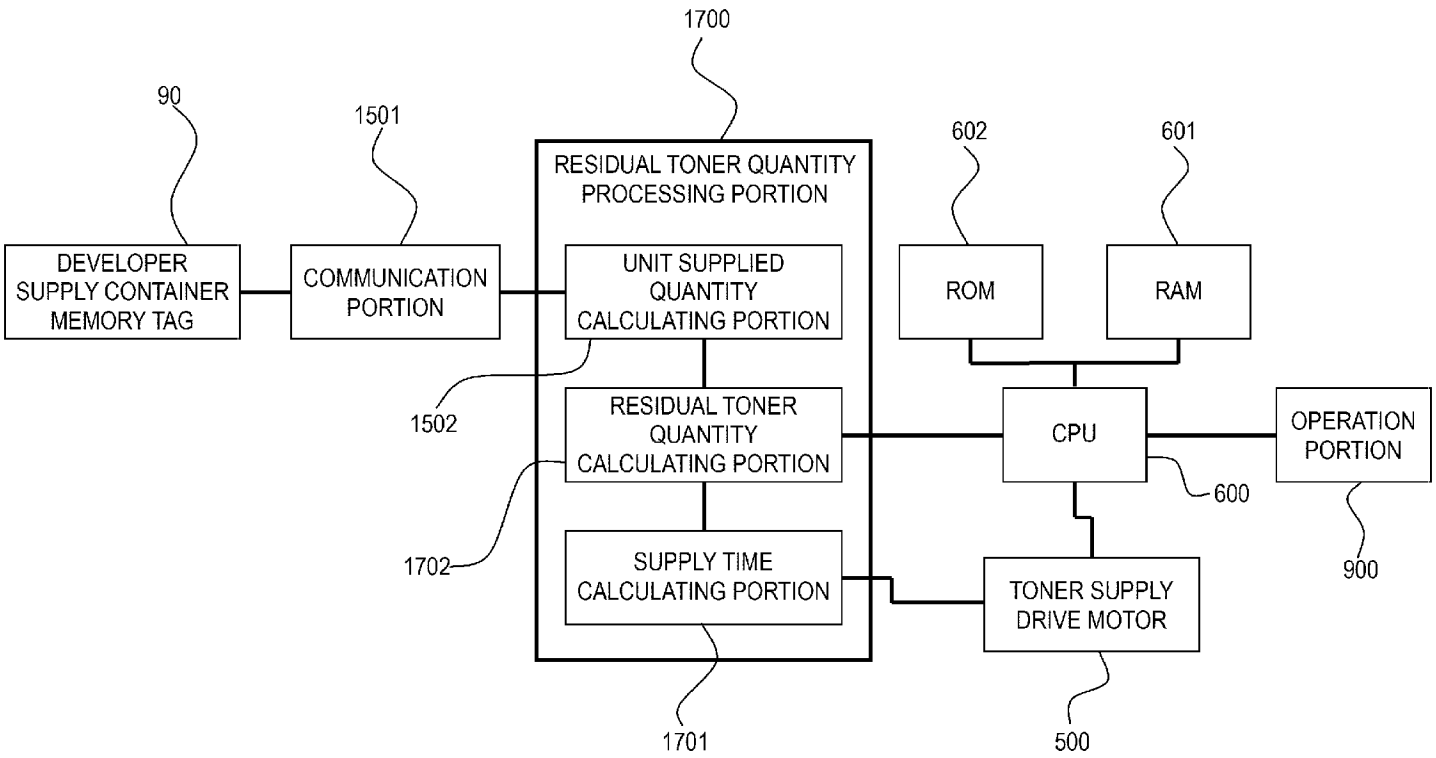
FIG. 19 is a block diagram illustrating residual toner quantity prediction control according to a third embodiment of the invention.

FIG. 19 is a block diagram illustrating a circuit configuration of a control board that predicts a residual quantity in the developer supply container according to this embodiment. In FIG. 19, elements having the same functions as in the above-mentioned embodiments will be referenced by the same reference signs.

Similarly to the first and second embodiments, toner supply is appropriately performed by the toner supply control. A supplied toner quantity is determined depending on a toner supply driving time determined by the CPU 600.

In a residual toner quantity processing portion 1700, a supply time calculating portion 1701 calculates a supply time in which the toner supply control is performed. For example, when the toner supply driving motor 500 is driven one sec, the developer supply container rotates by one turn and the supply of toner is performed two times in this embodiment. Accordingly, when the unit supplied quantity per driving time is set to 0.30 g, 0.60 g of toner is supplied.

In the residual toner quantity processing portion 1700, the unit supplied quantity calculating portion 1502 communicates with the memory tag 90 disposed in the developer supply container and the communication portion 1501 and corrects the unit supplied quantity based on the information in the memory tag, similarly to the first and second embodiments.

In the residual toner quantity processing portion 1700, a residual toner quantity calculating portion 1702 subtracts the supplied toner quantity which is supplied for the calculated toner supply time from a toner quantity filled in the developer supply container. The information on a filled toner quantity may be stored in the memory tag 90 or may be stored in the RAM 601 in the image forming apparatus. In this embodiment, the information is stored in the memory tag 90.

Figure 20:
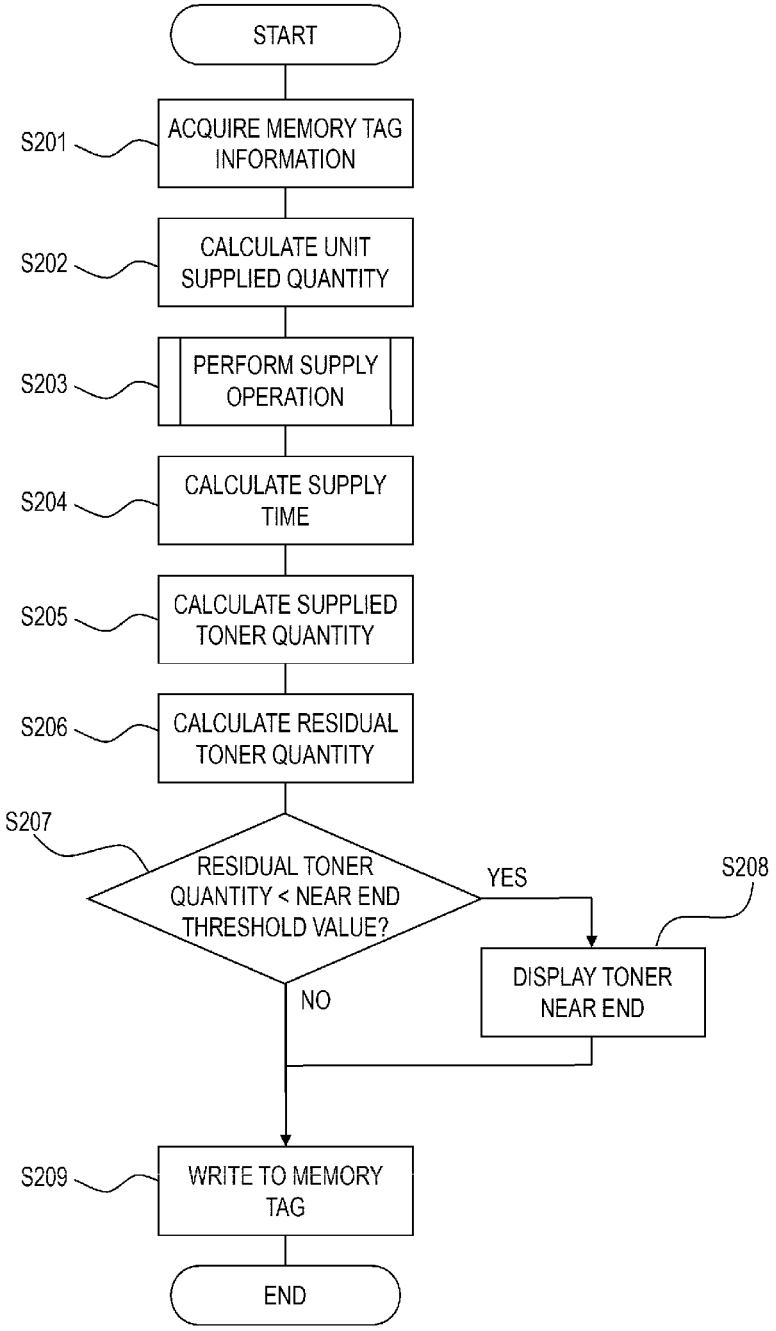
FIG. 20 is a flowchart illustrating the residual toner quantity prediction control according to the third embodiment of the invention.

FIG. 20 is a flowchart illustrating a process sequence of calculating a residual toner quantity of the developer supply container having a memory tag using the corrected unit supplied quantity.

In FIG. 20, when the process sequence starts, first, the memory tag information (the filled toner quantity, the residual toner quantity, the toner cohesion, and the component dimensions) which is information specific to the developer supply container is acquired by communication with the memory tag disposed in the developer supply container (S201). The unit supplied quantity is corrected based on the relationship between the memory tag information (the toner cohesion and the component dimensions) and the unit supplied quantity which is stored in the ROM in advance using the acquired memory tag information (the toner cohesion and the component dimensions) (S202). When the supply operation is performed by the toner supply control (S203), the supply time corresponding to the supply operation is calculated (S204). Then, the supplied toner quantity in S203 is calculated based on the unit supplied quantity corrected in S202 and the supply time calculated in S204 (S205). The supplied toner quantity calculated in S205 is subtracted from the filled toner quantity and the residual toner quantity acquired from the memory tag to calculate the residual toner quantity (S206). Then, when the residual toner quantity calculated in S206 is less than a threshold value (S207), that the residual toner quantity is small is displayed on a display panel of the operation portion 900 in the image forming apparatus (S208) and the newest residual toner quantity is written to the memory tag (S209). When the residual toner quantity calculated in S206 is greater than the threshold value, the newest residual toner quantity is written to the memory tag (S209) and the process sequence ends.

In this embodiment, the threshold value is set to 20%. In the comparative example, since the actual supplied toner quantity is greater 40% than the set unit supplied quantity, the residual toner quantity is 0% until that the residual toner quantity is small is displayed on the display panel.

On the other hand, in the third embodiment, when the unit supplied quantity is corrected in the same way as in the first embodiment, the difference between the actual used toner quantity and the predicted used toner quantity is about 8%.

In this way, according to this embodiment, it is possible to decrease a difference between the actual used toner quantity of each developer supply container and the predicted used quantity and to realize detection of a residual toner quantity with high accuracy even when a sensor that senses the residual toner quantity is not disposed in the developer supply container.

Other Embodiments

In the first to third embodiments, a so-called hopperless configuration in which developer is directly supplied from the developer supply container to the developing device is employed, but the supply configuration of the invention is not limited thereto. For example, the invention can be applied to any configuration as long as the supplied quantity varies based on information specific to the developer supply container such as toner cohesion.

In the above-mentioned embodiments, four image forming portions are used, but the number of image forming portions used is not particularly limited and can be appropriately set if necessary.

In the above-mentioned embodiments, a printer has been exemplified as the image forming apparatus, but the invention is not limited thereto. For example, the invention may be applied to other image forming apparatuses such as a copying machine and a facsimile or another image forming apparatus such as a multifunction machine having a combination of the functions. The same advantages can be achieved by applying the invention to a developer supply device of such an image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-105794, filed May 27, 2016, which is hereby incorporated by reference herein in its entirety.

What is claimed is:

1. An image forming apparatus comprising:

an image bearing member;

a developing device that develops an electrostatic latent image formed on the image bearing member;

a toner bottle which is configured to supply the developing device with toner, and having a storage portion storing the toner and a discharge portion made of resin and discharging the toner stored in the toner storage portion, with the storage portion configured to rotate relatively to the discharge portion;

an attachment portion configured to be attached with the toner bottle;

a driving portion configured to drive the storage portion in a state that the toner bottle is attached to the attachment portion;

a controller controlling the driving portion;

a memory disposed in the toner bottle and memorizing information regarding component dimensions of a molded discharge portion of the toner bottle; and an information reading portion that reads information regarding the component dimensions of the molded discharge portion;

wherein the controller controls the driving portion so that a discharge amount of the toner from the discharge portion becomes a specific toner amount targeted based on the information regarding the component dimensions of the molded discharge portion.

2. The image forming apparatus according to claim 1, wherein the controller controls a rotating amount of the storage portion at a time to rotate the storage portion by the driving portion so that a discharge amount of the toner from the discharge portion becomes a specific toner amount targeted based on the information regarding the component dimensions of the molded discharge portion.

3. The image forming apparatus according to claim 1, further comprising:

a pump portion disposed on the toner bottle and configured to expand and contract in a rotary axis direction of the storage portion; and a cam mechanism disposed on the toner bottle and configured to transfer driving force from the driving portion to the pump portion by changing the driving force in the rotary axis direction of the storage portion, wherein the toner is discharged from the discharging portion by rotating the storage portion for the driving portion to execute expanding and contraction movement of the pump portion.

* * * * *